US006848735B1

(12) United States Patent
Herr et al.

(10) Patent No.: US 6,848,735 B1
(45) Date of Patent: Feb. 1, 2005

(54) STEPWELL COVER APPARATUS

(75) Inventors: Devon L. Herr, Nappanee, IN (US); Lawrence A. Kirschbaum, Elkhart, IN (US); Devoe C. Hoffer, New Paris, IN (US)

(73) Assignee: Monaco Coach Corporation, Wakarusa, IN (US)

( * ) Notice: Subject to any disclaimer, the term of this patent is extended or adjusted under 35 U.S.C. 154(b) by 0 days.

(21) Appl. No.: 10/465,042

(22) Filed: Jun. 19, 2003

(51) Int. Cl.[7] ..... B60P 7/02

(52) U.S. Cl. ..... 296/100.1; 296/168; 296/155; 105/450; 105/455; 105/447; 280/166

(58) Field of Search ..... 296/100.1, 193.05, 296/193.07, 164, 156, 168, 65.04, 155; 105/450, 445, 447, 343; 280/166; 414/540; 49/340

(56) References Cited

U.S. PATENT DOCUMENTS

| | | | | | |
|---|---|---|---|---|---|
| 2,024,338 | A | * | 12/1935 | Christiansen et al. | 105/450 |
| 3,572,754 | A | * | 3/1971 | Fowler | 105/447 |
| 3,574,322 | A | * | 4/1971 | Hancock et al. | 280/166 |
| 3,924,545 | A | * | 12/1975 | Anders et al. | 105/450 |
| 3,955,827 | A | * | 5/1976 | Wonigar | 105/445 |
| 4,020,920 | A | * | 5/1977 | Abbott | 105/445 |
| 4,058,228 | A | | 11/1977 | Hall | |
| 4,116,457 | A | | 9/1978 | Nerem et al. | |
| 4,131,209 | A | | 12/1978 | Manning | |
| 4,174,115 | A | | 11/1979 | Youngblood | |
| D256,618 | S | | 8/1980 | Klein | |
| 4,273,498 | A | * | 6/1981 | Dickhart et al. | 296/65.04 |
| 4,685,858 | A | | 8/1987 | Manning et al. | |
| 4,721,319 | A | | 1/1988 | Dale | |
| 4,759,682 | A | | 7/1988 | Hood | |
| 5,165,839 | A | * | 11/1992 | Aoki | 414/541 |
| 5,375,962 | A | * | 12/1994 | Kempf | 414/541 |
| 5,842,709 | A | | 12/1998 | Maccabee | |
| 5,964,498 | A | * | 10/1999 | DiBiagio | 296/168 |
| 6,213,486 | B1 | * | 4/2001 | Kunz et al. | 280/166 |
| 6,263,804 | B1 | * | 7/2001 | Rizk | 105/450 |
| 6,264,222 | B1 | * | 7/2001 | Johnston et al. | 105/447 |
| 6,443,072 | B2 | * | 9/2002 | Rizk | 296/155 |
| 6,640,728 | B1 | * | 11/2003 | Neugebauer | 105/343 |

* cited by examiner

*Primary Examiner*—Kiran Patel
(74) *Attorney, Agent, or Firm*—Baker & Daniels

(57) ABSTRACT

A stepwell cover apparatus for use in a vehicle having a stepwell including a step that is located below the floor of the vehicle. The apparatus includes a horizontal cover that may be retracted to a position below the floor in order to expose the steps of the stepwell and may be extended to a position flush with the floor in order to conceal the steps of the stepwell. In addition, the stepwell cover apparatus includes a drive mechanism for driving the horizontal cover between the fully extended and the fully retracted positions, a guide mechanism for guiding the horizontal cover during movement and pivot members that cooperate with the drive and guide mechanisms to raise the horizontal cover to a level flush with the floor when the cover reaches the fully extended position.

10 Claims, 25 Drawing Sheets

STEPWELL COVER APPARATUS

BACKGROUND OF THE INVENTION

1. Field of the Invention

The present invention relates to a stepwell cover apparatus for use in motor vehicles.

2. Description of Prior Art

Various stepwell covers for vehicles are known. For example, U.S. Pat. No. 3,924,545 discloses a railway car dual access level selection apparatus. The apparatus, intended for use in rail cars, includes a retractable platform supported by a plurality of parallel links pivotable at each end on a pair of bars movable in tracks affixed to the sidewalls of the stairwell. The platform further includes a cam follower engaging a camtrack located in the stairwell in order to guide movement of the platform between a lower level access position located under the floor of the car and an upper level access position covering the stepwell at floor level.

A second example of a known stepwell cover is U.S. Pat. No. 4,174,115, which discloses a motorized bi-fold stepwell cover. The disclosed stepwell cover comprises a deck consisting of first and second deck segments pivotally secured together. The cover further includes an actuating mechanism arranged to move the first deck segment through an angle of ninety degrees while moving the second segment through an angle of one hundred eighty degrees relative to the first segment. This mechanism moves the stepwell cover between a first position covering the stepwell and a second position providing access to the stepwell.

U.S. Pat. No. 5,694,498 represents another example of a known stepwell cover apparatus. The stepwell cover apparatus disclosed allows for the selective covering a stepwell cavity in a trailer. The apparatus broadly comprises a cover plate for covering the stepwell cavity, an actuator for positioning the cover plate between a retracted position and an extended position, and a guide assembly for moving the cover plate between the retracted and extended positions.

SUMMARY OF THE INVENTION

The present invention comprises a stepwell cover apparatus for use in a vehicle having a stepwell including at least one step and a floor disposed at a height above the step. The stepwell cover apparatus includes a horizontal cover, moveable between an extended position and a retracted position, and attached to a first stop member that includes an opening. A first dowel pin extends through the opening and has one end affixed to a fixed point. The apparatus also includes a pivoting member connected to the horizontal cover at a first end and attached to a drive mechanism at a second end. The drive mechanism includes a rod and a drive assembly that is connected to the rod and able to travel the length of the rod. In addition, the stepwell cover apparatus includes a guide mechanism including a sliding assembly. The pivoting member attaches to the sliding assembly at a pivot point that is located between the first end and the second end. Furthermore, the movement of the horizontal cover into the retracted position locates the cover below the floor, while the movement of the horizontal cover into the extended position allows the cover to conceal the steps of the stepwell.

In one embodiment, the stepwell cover apparatus may additionally include a frame for uniting the components of the apparatus. The frame includes a base, and a plurality of walls defining an inner space in which the components of the apparatus are located when in the retracted position.

Furthermore, in one embodiment, the drive assembly also includes a nut threaded onto the rod and a nut cage fastened to the nut. The nut cage includes arms, extending therefrom, attached to the pivot members. As the nut traverses the rod, the arms of the nut cage drive the pivot members and the horizontal cover, attached thereto.

Further features of the present invention will become apparent from the detailed description contained herein. However, it should be understood that the detailed description and specific examples, while indicating embodiments of the invention, are given by way of illustration only, since various changes and modifications within the spirit and scope of the invention will become apparent to those skilled in the art.

BRIEF DESCRIPTION OF THE DRAWINGS

These and other features of the invention will become more apparent and the present invention will be better understood upon consideration of the following description and the accompanying drawings wherein.

DETAILED DESCRIPTION OF EMBODIMENTS OF THE INVENTION

The embodiments of the invention described herein are not intended to he exhaustive, nor to limit the invention to the precise forms disclosed. Rather, the embodiments selected for description have been chosen to enable one skilled in the art to practice the invention.

Figure 1:
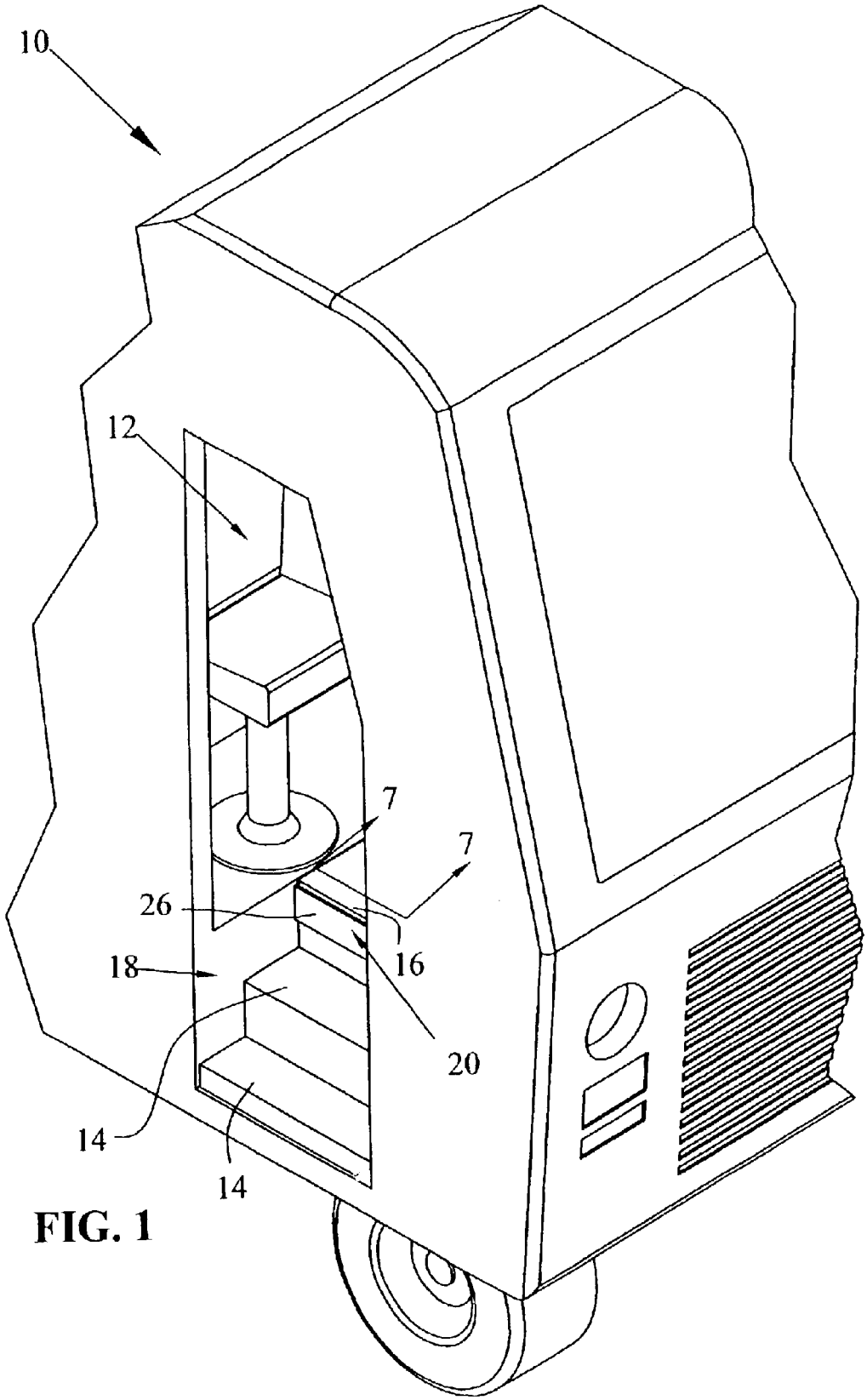
FIG. 1 depicts a perspective view of a recreational vehicle including an embodiment of a stepwell cover apparatus according to the present invention.

FIG. 1 depicts a perspective view of a recreational vehicle generally indicated by numeral 10. Vehicle 10 includes a side entry doorway generally indicated by the numeral 12, a plurality of steps 14, and a floor 16. The area of the vehicle 10 located between the horizontal plane of floor 16 and the steps 14 define a stepwell generally indicated by numeral 18. FIG. 1 depicts vehicle 10 as also including a stepwell cover apparatus generally indicated by numeral 20.

Figure 2:
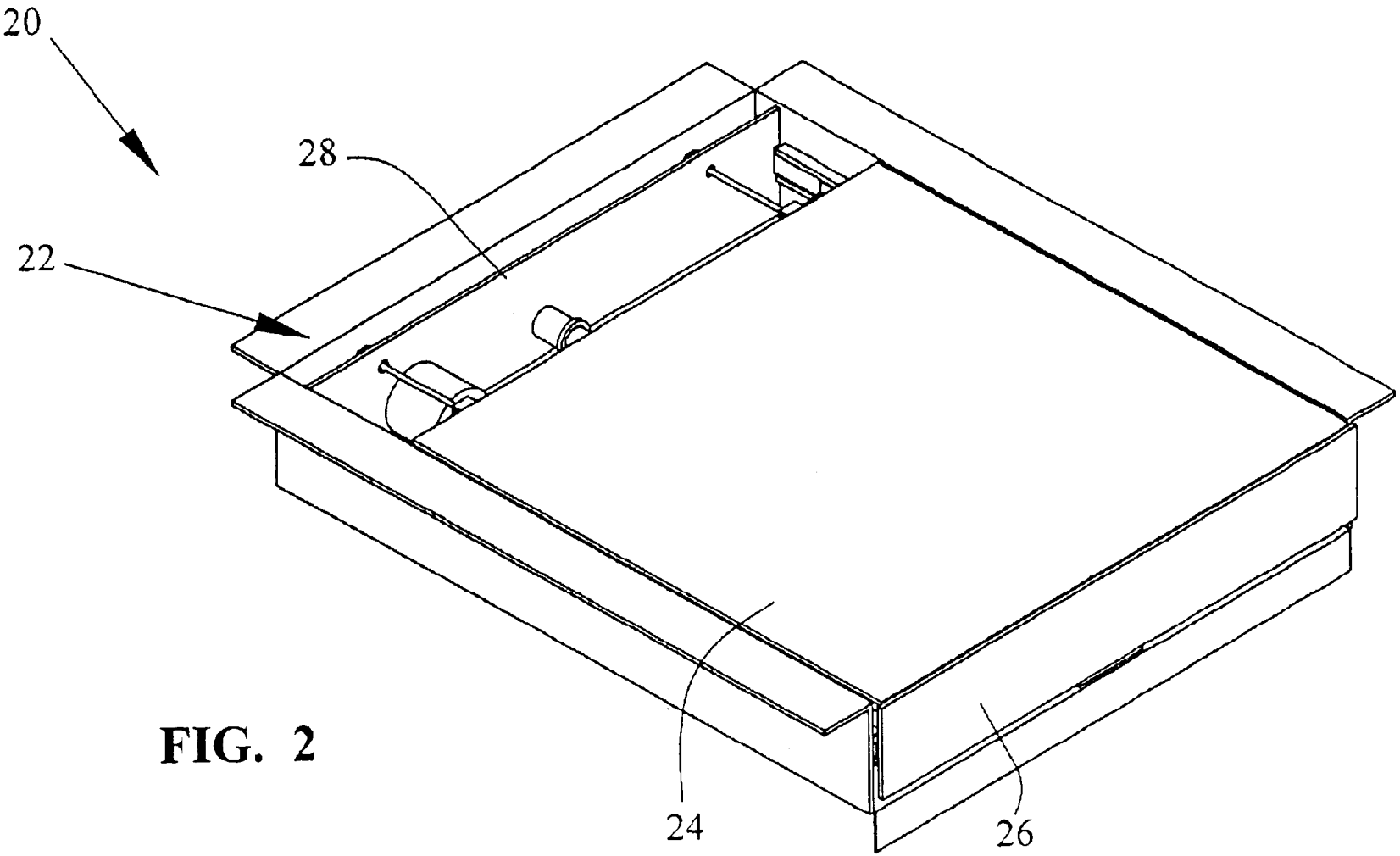
FIG. 2 depicts a perspective view of the stepwell cover apparatus illustrated in FIG. 1.

FIG. 2 depicts a perspective view of the stepwell cover apparatus 20. In FIG. 2, the stepwell cover apparatus 20 is shown in the fully retracted position. The exterior of the stepwell cover apparatus 20 includes a frame generally indicated by numeral 22, a first or horizontal cover 24, and a second or vertical cover 26. Both the horizontal cover 24 and the vertical cover 26 are rectangular, planar components.

Figure 3:
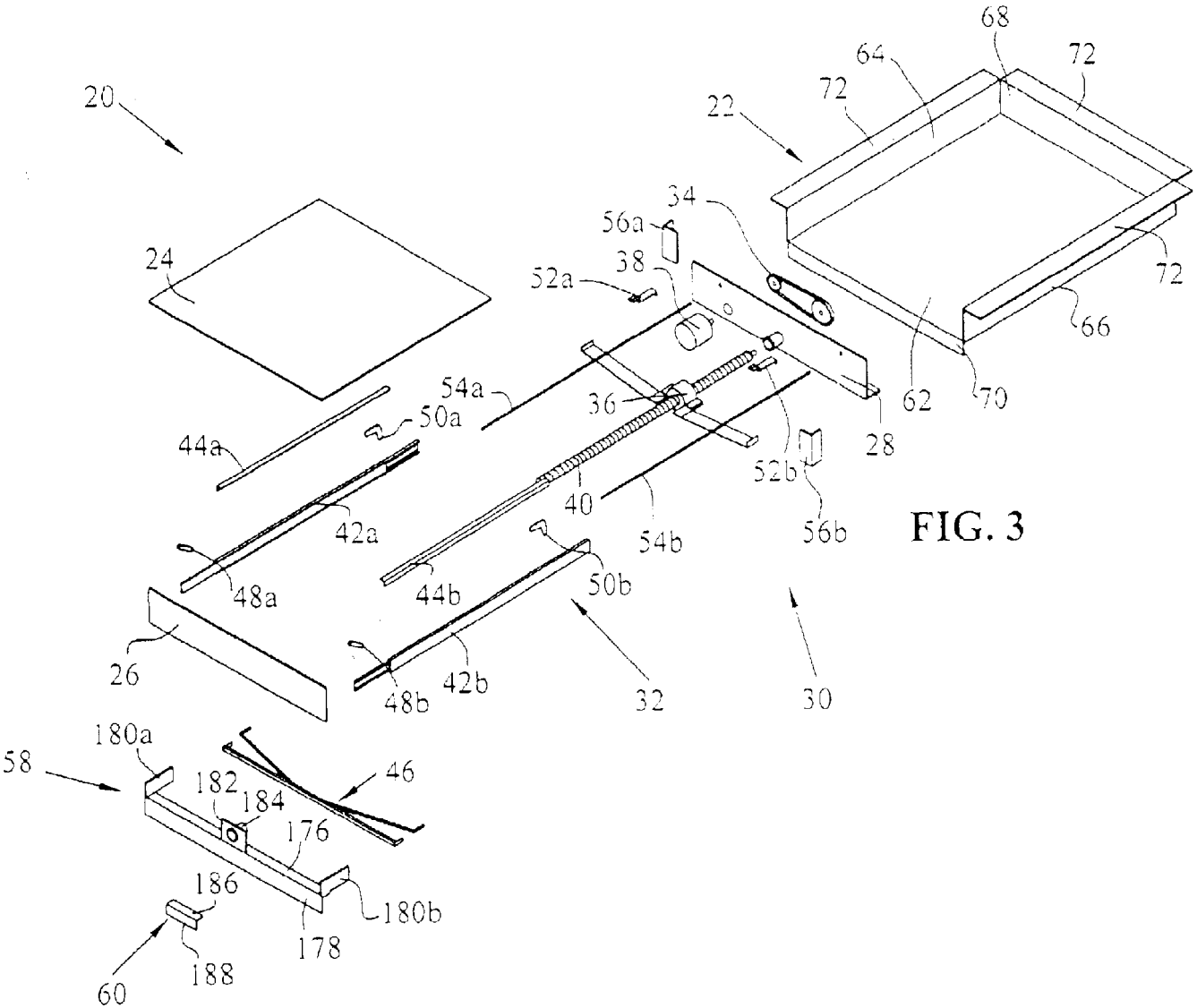
FIG. 3 depicts an exploded perspective view of the stepwell cover apparatus illustrated in FIG. 2.

FIG. 3 depicts an exploded perspective view of the stepwell cover apparatus 20. This figure illustrates that the stepwell cover apparatus 20 further includes a plate 28, a drive mechanism generally indicated by numeral 30, a guide mechanism generally indicated by numeral 32, a pair of stops 52*a*, 52*b*, a pair of dowels 54*a*, 54*b*, a pair of angle irons 56*a*, 56*b*, a bracket 58, and a bracket 60. The relative location of the individual components of each pair in this apparatus 20 is identified with the arbitrary designations of "a" and "b". The designator "a" indicates a component of any pair located on the right side of the apparatus 20, while the designator "b" indicates the corresponding component of each pair located on the left side of the apparatus 20.

Referring still to FIG. 3, a frame 22 is also depicted. The frame 22 includes base 62, wall 64, wall 66, wall 68, flange 70, and a plurality of flanges 72. Base 62 is a substantially planar component, having a rectangular shape, from which the walls 64, 66, 68 each extend upwardly. Wall 64 and wall 66 extend parallel along two opposite edges of base 62, while wall 68 extends along one of the remaining edges of base 62. Additionally, in this embodiment, flange 70 extends downward along the edge of base 62 opposite wall 68. In the embodiment depicted, the distance that flange 70 extends downward from base 62 is not as great as the height of the walls 64, 66, 68 above base 62. However, in alternative embodiments, the distance flange 70 extends away from base 62, along with the height of the walls 64, 66, 68, may vary as required.

As stated above, the frame 22 also includes a plurality of flanges 72 each extending parallel to base 62. Flanges 72 each extend outward, away from the center of frame 22, with each one of the flanges 72 being connected to the top edge of a different wall 64, 66, 68, thereby locating each of the flanges 72 in the same plane. Alternatively, frame 22 may be manufactured from molded plastic.

Figure 4:
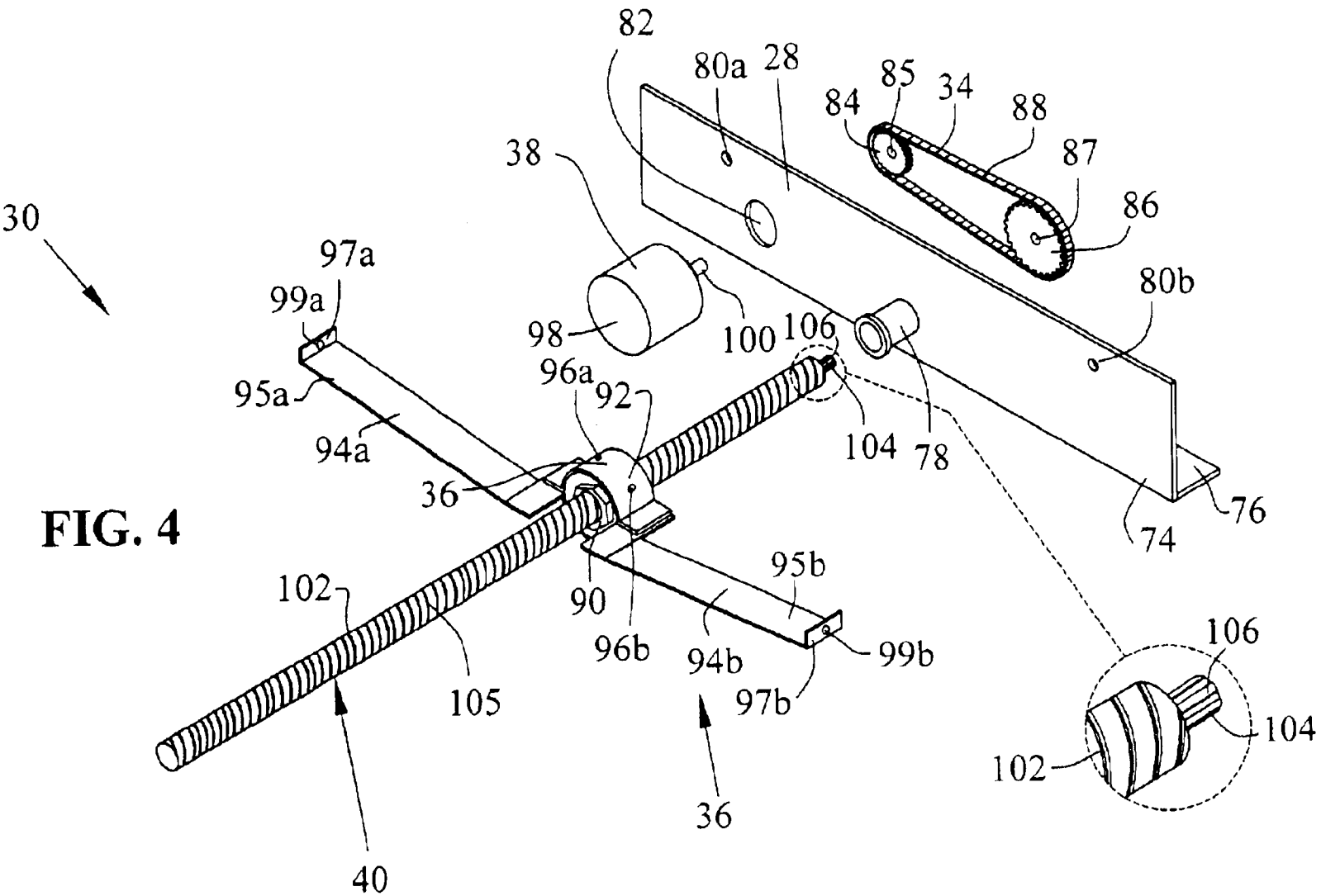
FIGS. 4 and 4A depict alternative embodiments of exploded perspective views of a drive mechanism that is a component of the stepwell cover apparatus illustrated in FIG. 2.

FIG. 4 depicts a perspective view of plate 28 and drive mechanism 30. Plate 28 includes a vertical portion 74 joined at a right angle to a horizontal portion 76. In the depicted embodiment of plate 28, vertical portion 74 and horizontal portion 76 are fashioned from one piece of material, bent to form a ninety degree angle distinguishing the two portions 74, 76. However, vertical portion 74 and horizontal portion 76 may be formed from two separate pieces of material joined together. Vertical portion 74 includes bearing 78, a pair of openings 80*a*, 80*b*, and opening 82. Bearing 78 is pressed into an opening (not shown) located near the center of vertical portion 74, with the openings 80*a*, 80*b* being spaced equidistant therefrom. In this embodiment, openings 80*a*, 80*b* are located above bearing 78. Opening 82 extends through vertical portion 74 and has a diameter larger than the diameters of the openings 80*a*, 80*b*. In addition, opening 82 is located nearer to bearing 78 than either of the openings 80*a*, 80*b*. However, in alternative embodiments, opening 82 may be located at a variety of different positions within vertical portion 74, as desired.

Referring still to FIG. 4, drive mechanism 30 includes mechanism 34 comprising gear 84, gear 86, and chain 88. Gears 84 and 86 include openings 85, 87, respectively. Furthermore, each gear 84, 86 includes a plurality of teeth able to intermesh with chain 88 in a manner well known. In the embodiment depicted, gear 84 has a smaller diameter and fewer teeth than does gear 86. Consequently, one full rotation of gear 84 produces less than one full rotation of gear 86. However, the diameters of gears 84, 86 and the corresponding number of teeth may be varied, as needed.

Figure 4A:
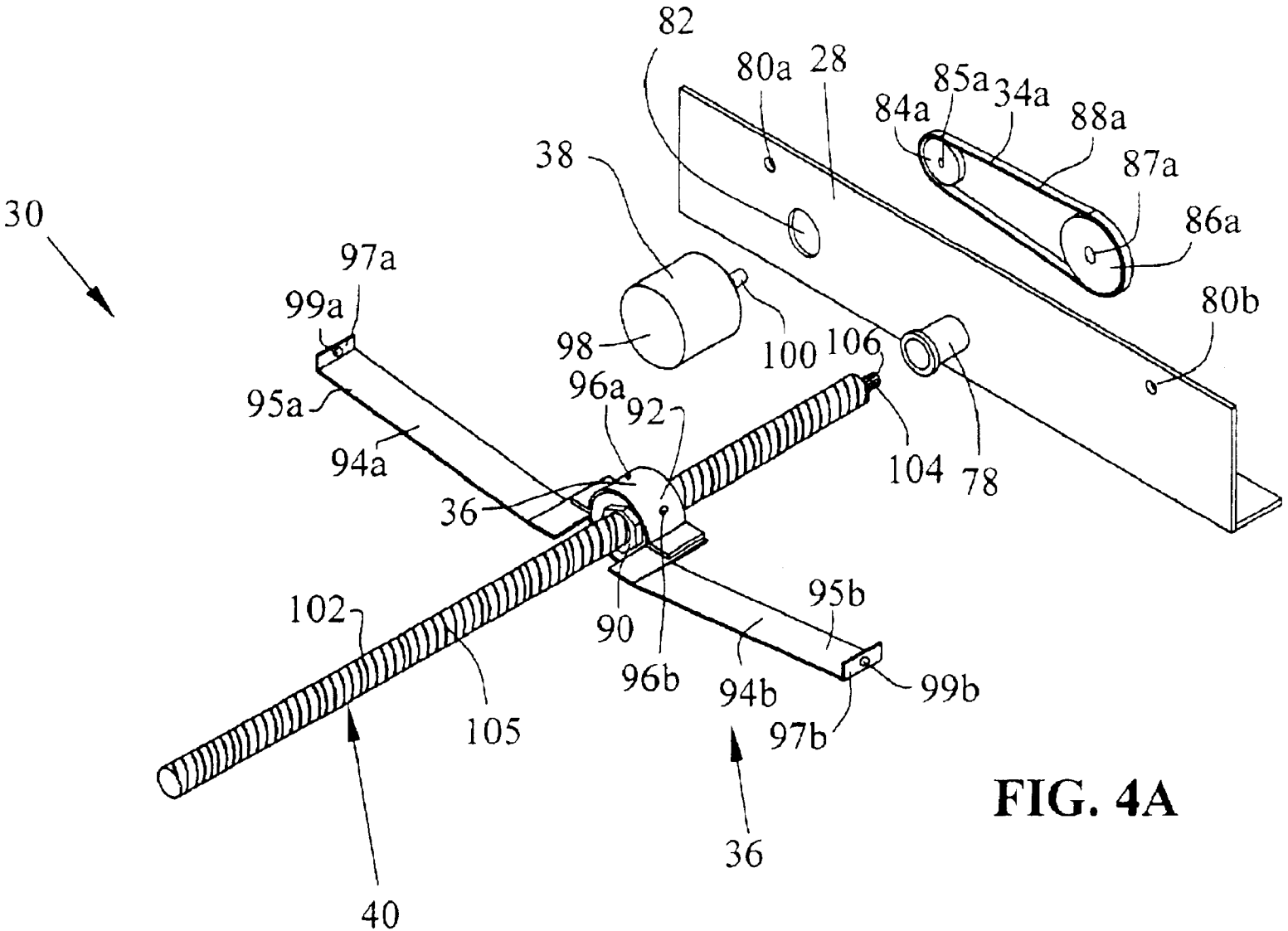

FIG. 4A depicts an alternative embodiment of mechanism 34*a* that may be substituted for mechanism 34 in drive mechanism 30. In this alternative embodiment of mechanism 34*a*, pulleys 84*a*, 86*a*, and belt 88*a* replace gears 84, 86 and chain 88, respectively. Pulleys 84*a* and 86*a* each include a valley, in a manner well known. As depicted, belt 88*a* resides within the valley portion of the pulleys 84*a*, 86*a*, thereby interconnecting the pulleys 84*a*, 86*a* and allowing the transfer of rotational motion. Furthermore, additional combinations of components allowing rotational energy to be transferred from motor 38 to a shaft 100.

Referring again to FIG. 4, drive mechanism 30 also includes a nut 90, a nut cage 92, and a pair of arms 94*a*, 94*b*. Nut cage 92 has an inner surface configured engage the outer surface of nut 90. Nut cage 92 is affixed to nut 90 by a plurality of fasteners 96*a*, 96*b* that extend through nut cage 92 and are threaded into holes on the outside of nut 90. It should be noted that in alternative embodiments, the inner surface of nut cage 92 need not complement the outer surface of the nut 90. Rather, the nut cage 92 may be connected to nut 90 solely by the employment of fasteners 96*a*, 96*b*.

A pair of arms 94*a*, 94*b* extends laterally from nut cage 92. Nut cage 92 and arms 94*a*, 94*b* may be fastened together by way of any known methods, such as welding or through the use of fasteners.

Referring still to FIG. 4, each of the arms 94*a*, 94*b* includes a horizontal portion 95*a*, 95*b* and a vertical portion 97*a*, 97*b*, respectively. In the embodiment depicted, the horizontal portions 95*a*, 95*b* take the shape of a rectangle with the vertical portion 97*a*, 97*b* extending upwards perpendicularly from the end thereof. Openings 99*a*, 99*b* extend through the center of the vertical portions 97*a*, 97*b*, respectively. However, it should be noted that in alternative embodiments, openings 99*a*, 99*b* might be offset from the center of vertical portions 97*a*, 97*b*, as required.

Drive mechanism 30 further includes a motor 38 including a housing 98 and a shaft 100. Shaft 100 extends through opening 82 of vertical portion 74 and into opening 85 of gear 84. Shaft 100 engages gear 84 in a known manner ensuring gear 84 rotates with shaft 100.

Drive mechanism 30 also includes a rod 40 having a threaded portion 102 and a portion 104 having splines 106. Splines 106 engage opening 87 in gear 86, as described below. Note that splines 106 could be eliminated and rod 40 could be secured to gear 86 in another manner.

Figure 5:
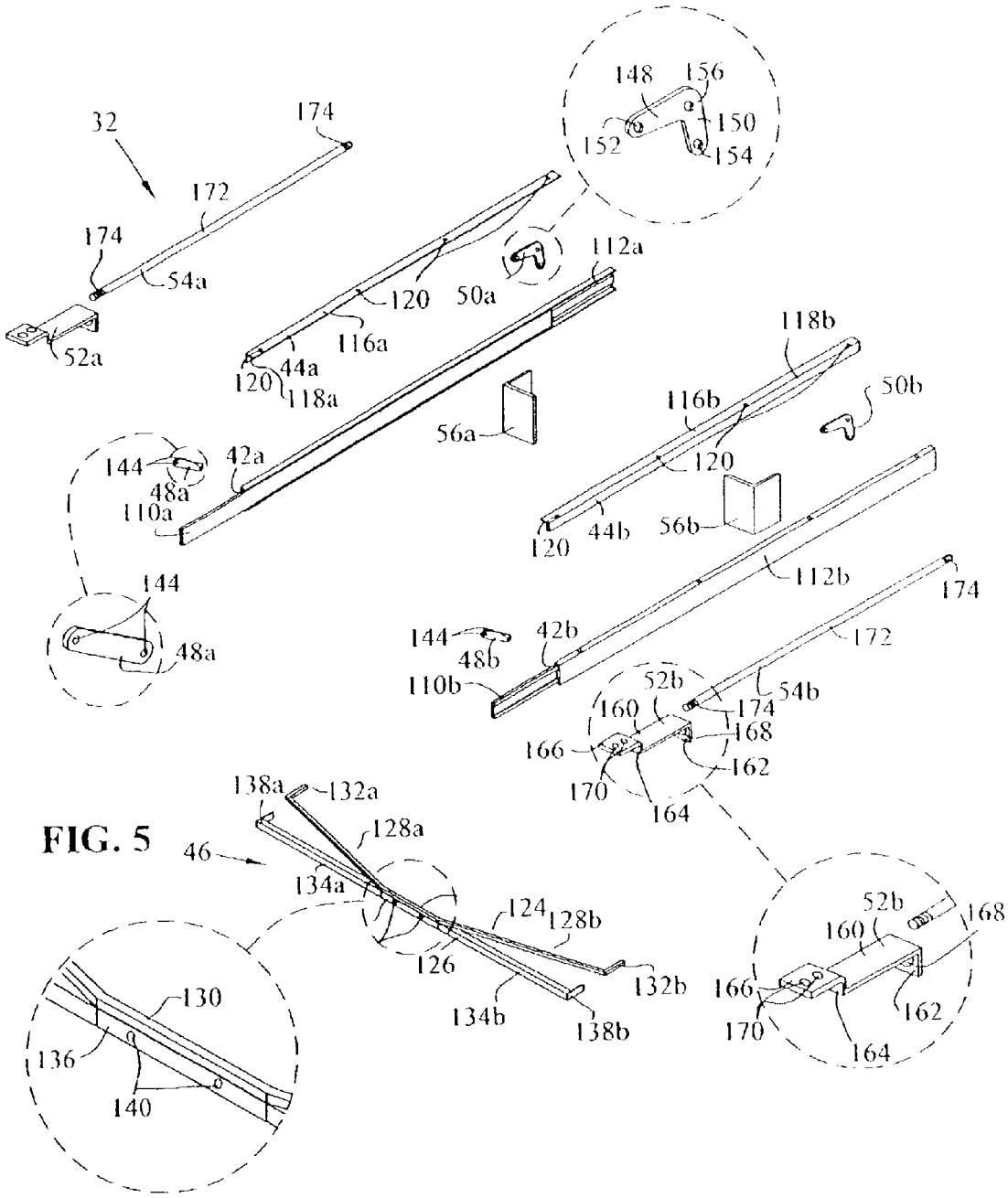
FIG. 5 depicts an exploded perspective view of a guide mechanism that is a component of the stepwell cover apparatus illustrated in FIG. 2.

Referring now to FIG. 5, guide mechanism 32 is depicted. Guide mechanism 32 includes a pair of slide assemblies 42*a*, 42*b*, a pair of brackets 44*a*, 44*b*, cross support 46, a pair of pivot members 48*a*, 48*b*, a second pair of pivot members 50*a*, 50*b*, a pair of stops 52*a*, 52*b*, a pair of dowels 54*a*, 54*b*, and a pair of angle irons 56*a*, 56*b*.

The slide assemblies 42*a*, 42*b* each include a movable member 110*a*, 110*b* and a fixed member 112*a*, 112*b*, respectively. In the embodiment depicted, moveable members 110*a*, 110*b* slide within fixed members 112*a*, 112*b*.

Referring still to FIG. 5, each bracket 44*a*, 44*b* includes a horizontal portion 116*a*, 116*b* and a vertical portion 118*a*, 118*b*, respectively. Horizontal portions 116*a*, 116*b* include a plurality of openings 120 spaced throughout.

FIG. 5 also depicts cross support 46 having an angled portion 124 including a pair of arms 128*a*, 128*b*, and a connecting plate 130. The arms 128*a*, 128*b* extend outward and rearward from plate 130 and each arm 128*a*, 128*b* includes a support plate 132*a*, 132*b* attached opposite connecting plate 130.

Similarly, cross support 46 also includes a linear portion 126 having a pair of arms 134*a*, 134*b*, and a connecting plate 136. The arms 134*a*, 134*b* extend outward from plate 136 along the identical axis. Each arm 134*a*, 134*b* includes support plates 138*a*, 138*b* attached opposite the connecting plate 136.

In the final assembly of cross support 46, fasteners 140 extend through the connecting plates 130, 136, to affix angle portion 124 to linear portion 126. It should be noted that the fasteners 140 may be replaced by any number of methods suitable for joining connecting plates 130, 136 together. For example, the connecting plates 130, 136 may be welded.

As stated above, guide mechanism 32 also includes a pair of pivot members 48*a*, 48*b*. Pivot members 48*a*, 48*b*, in the embodiment shown, have the shape of an elongated oval, with openings 144 located near the ends.

Referring still to FIG. 5, pivot members 50*a*, 50*b* are illustrated as generally L-shaped. Pivot members 50*a*, 50*b* include longer portions 148, shorter portions 150, and openings 152, 154, 156. Opening 152 extends through longer portion 148, while opening 154 extends through shorter portion 150. Opening 156 is located between opening 152 and opening 154.

Referring still to FIG. 5, stops 52*a*, 52*b* each include body 160, portion 162, portion 164, and portion 166. Portion 162 and portion 164 each extend perpendicularly away from opposite ends of body 160, in opposite directions. In this embodiment, portion 162 extends downward from one end of body 160 while portion 164 extends upward from the opposite end of body 160. Portion 162 extends a greater distance from body 160 than does portion 164. Portion 166 extends parallel to body 160 from the top edge of portion 164, forming a right angle therebetween. Portion 162 includes an opening 168. Portion 166 includes a plurality of openings 170 extending therethrough.

FIG. 5 also depicts dowels 54*a*, 54*b*. The dowels 54*a*, 54*b* include a smooth portion 172 and two threaded portions 174 located at each end.

Referring again to FIG. 3, bracket 58 includes horizontal portion 176, vertical portion 178, and a pair of arms 180*a*, 180*b*. Arms 180*a*, 180*b* are connected to opposite ends of horizontal portion 176. In this embodiment, arms 180*a*, 180*b* extend rearward from horizontal portion 176. Plate 182 extends upward from horizontal portion 176 between the arms 180*a*, 180*b*. Bearing 184 extends through plate 182 and may be secured thereto by way of welding or other means.

FIG. 3 also depicts bracket 60 having a horizontal portion 186 and vertical portion 188. In the embodiment depicted, vertical portion 188 forms a 90° angle relative to horizontal portion 186.

Referring now to FIGS. 6A–6H, the assembly of stepwell cover apparatus 20 will now be described. It should be noted that the following description of the assembly process is for illustrative purposes only and, as will be apparent to one having ordinary skill in the art, the order of the steps may be altered without departing from the spirit and scope of the invention. Furthermore, when the assembly process involves pairs of components located on opposite sides of the stepwell cover apparatus 20, the assembly of only one set of components will be described, with the understanding that the corresponding pair of components on the opposite side of the apparatus 20 is assembled in the same manner.

Figure 6A:
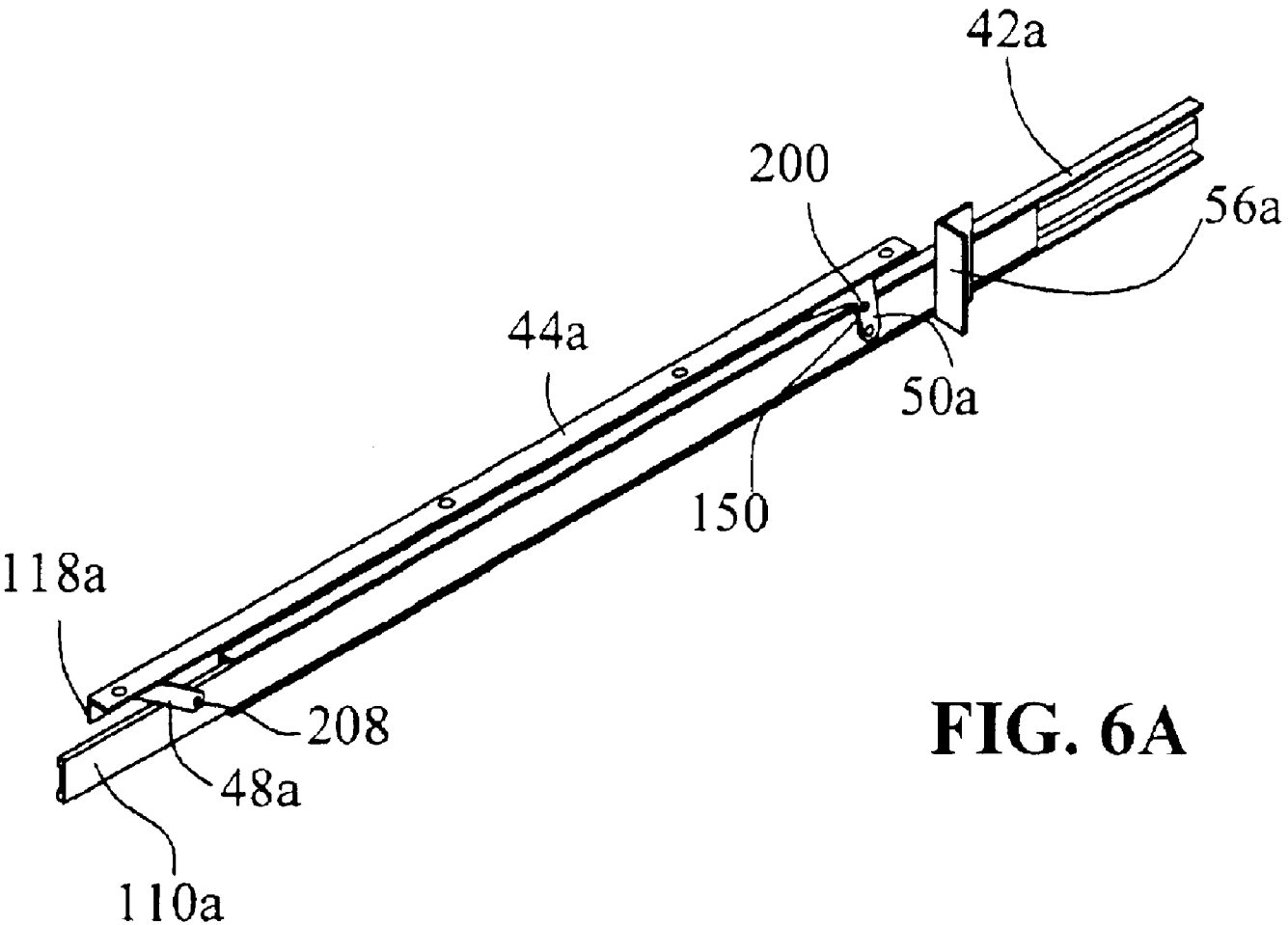
FIGS. 6A–6H depict perspective views showing the steps of assembling the stepwell cover apparatus illustrated in FIG. 2.

FIG. 6A illustrates the joining of the piston members 48*a*, 50*a*, bracket 44*a*, and angle iron 56*a* to the sliding assembly 42*a*. Pivot member 48*a* is secured to bracket 44*a* by inserting a fastener (not shown) through opening 144 and into vertical portion 118*a*. A second fastener is then inserted through the opening 152 in pivot member 50*a* and into vertical portion 118*a*, thereby joining pivot member 50*a* to bracket 44*a*. It should be noted that pivot member 50*a* is attached to bracket 44*a* with shorter portion 150 pointing forward, i.e. toward pivot member 48*a* when shorter portion 150 is orientated horizontally. The fasteners may be of any type known in the art, as long as they allow for the rotation of pivot members 48*a*, 50*a* about the fasteners. Rivets (not shown) are one example of an acceptable fastener.

In a similar manner to that described above, pivot member 48*a* is attached to movable member 110*a* of sliding assembly 42*a* by inserting a fastener 200 into moveable member 110*a* through the remaining opening 144 of the pivot member 48*a*. Likewise, a second fastener 200 attaches pivot member 50*a* at opening 156 to movable member 110*a*.

Angle iron 56*a* is attached to movable member 110*a* such that it cannot move relative to moveable member 110*a*. Angle iron 56*a* is positioned at a height and a location so as to ensure no contact between bracket 44*a* and angle iron 56*a* occurs as pivot member 50*a* pivots about opening 156, as described below. However, bracket 56*a* is positioned such that bracket 44*a* comes to rest upon the top surface of angle iron 56*a* when opening 152 is located directly above opening 156, as described below.

Figure 6B:
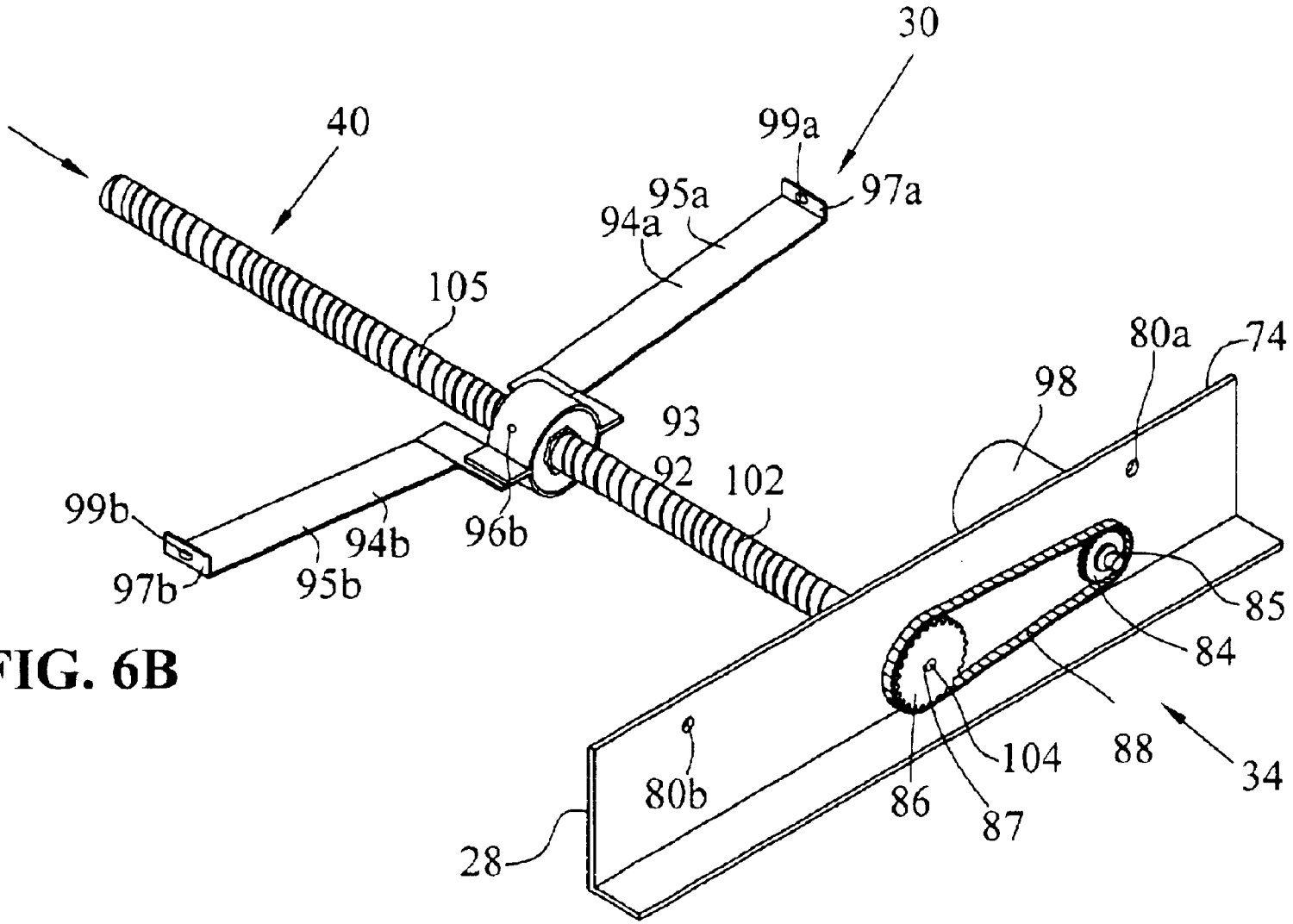

Referring now to FIG. 6B, rod 40 is threaded into nut 90, and nut cage 92, with arms 94*a*, 94*b* attached thereto, as described above, is attached to nut 90.

FIG. 6B also illustrates that motor 38 is affixed to plate 28 by the insertion of shaft 100 into opening 82 and the securing of housing 98 to vertical portion 74 by fasteners or other means.

Portion 104 of rod 40 is then inserted through bearing 78 so that portion 104 extends beyond the back side of plate 28. Bearing 78 is configured such that only portion 104 of rod 40 can extend through plate 28.

Once rod 40 has been inserted into bearing 78, mechanism 34 is attached to both the motor 38 and the rod 40. This is accomplished by attaching gear 86 to splines 106 on portion 104. In this manner, rotating gear 86 rotates rod 40. Gear 84 is attached to shaft 100 in a manner such that rotation of shaft 100 rotates gear 84. Once the gears 84, 86 have been attached to motor 38 and rod 40, respectively, chain 88 is connected to gears 84, 86 so that the rotation of either one of the gears 84, 86 will create rotation in the other.

Figure 6C:
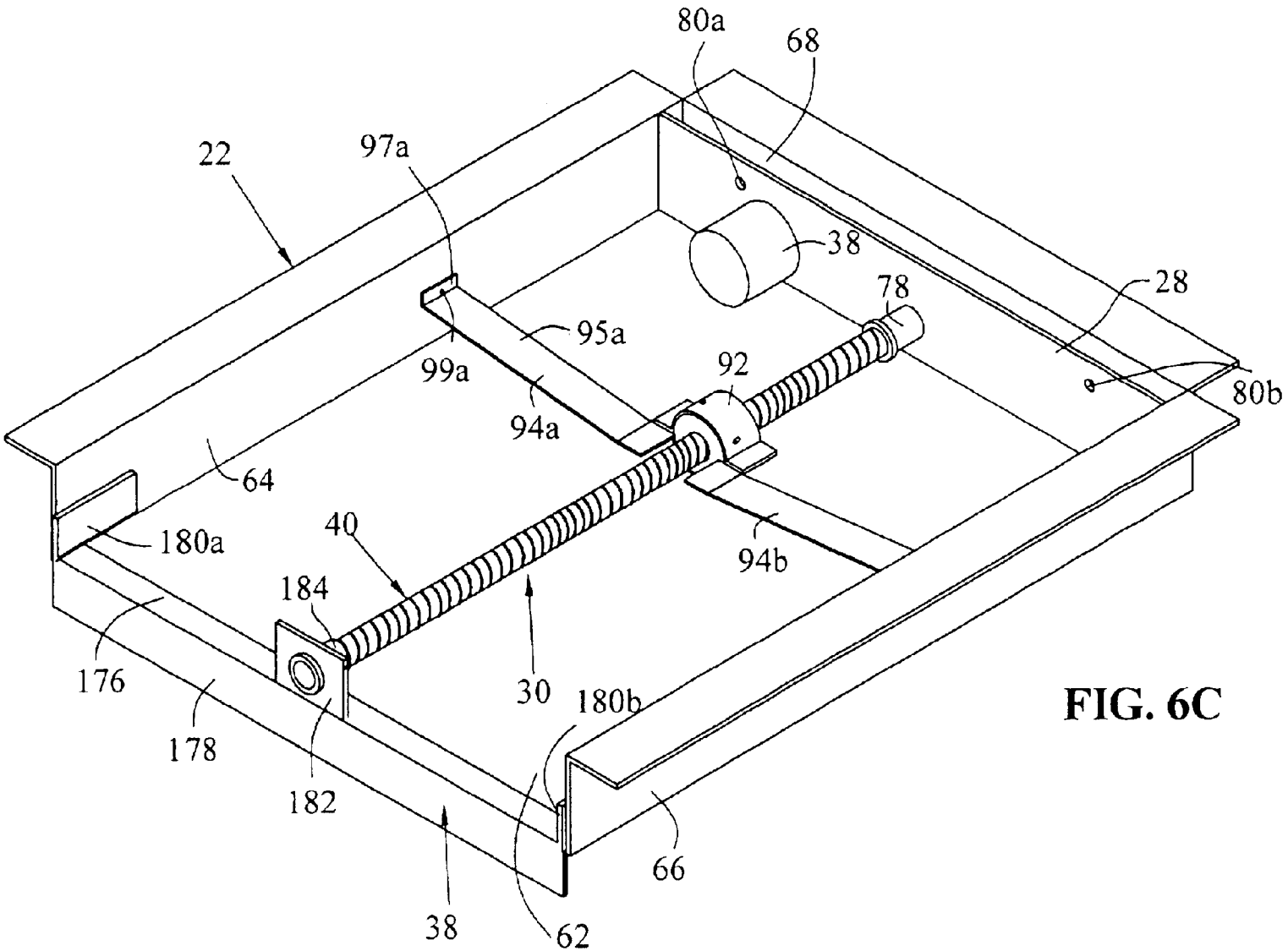

Referring to FIG. 6C drive mechanism 30 is attached to frame 22 by locating plate 28 in frame 22 so that plate 28 extends parallel to wall 68. Horizontal portion 76 of plate 28 abuts against wall 68 in order to ensure proper location of the plate 28 within the frame 22. Once plate 28 has been properly located, the horizontal portion 76 is connected to the base 62.

Bracket 58 is then positioned such that vertical portion 178 contacts flange 70 and horizontal portion 176 contacts base 62, and one end of rod 40 is retained within bearing 184. Arms 180*a*, 180*b* of bracket 58 are located inside frame 22 with one of the arms 180*a* being located adjacent wall 64 and the other of the arms 180*b* being located adjacent wall 66. In this manner, rod 40 is retained between plate 28 and plate 182. Once bracket 58 is positioned within frame 22, bracket 58 may be affixed to frame 22 via any number of known methods. For example, bracket 58 may be welded to frame 22.

Figure 6D:
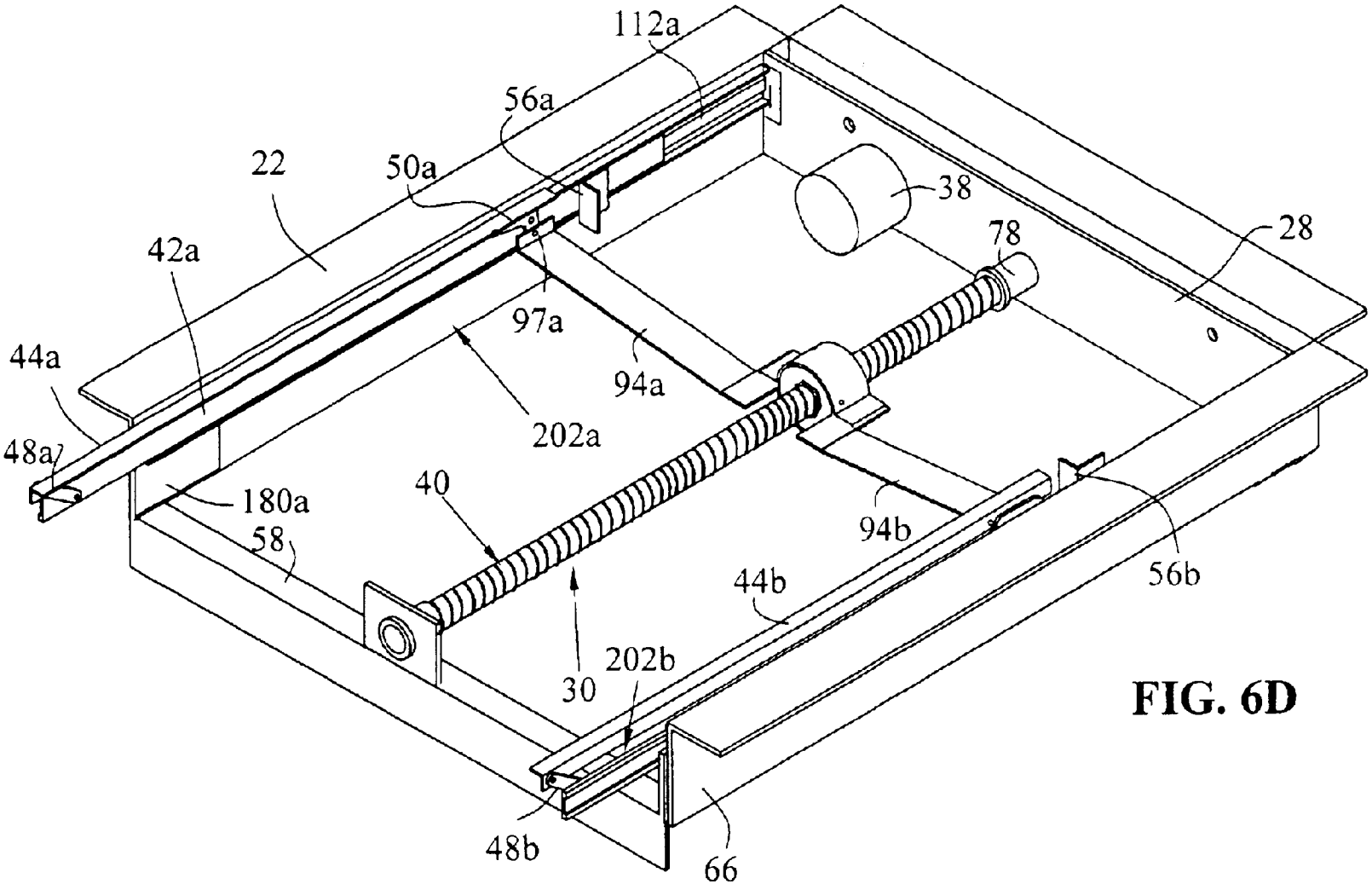

Referring to FIG. 6D, fixed member 112*a* of sliding assembly 42*a* is affixed to arm 180*a* of bracket 58 in any one of a number of know ways. It should be appreciated, however, that the attachment method chosen must not interfere with the movement of moveable member 110*a* within fixed member 112*a*. In the embodiment depicted, one end of fixed member 112*a* also contacts plate 28 and is affixed thereto. This connection provides additional support to fixed member 112*a*, if necessary.

Referring still to FIG. 6D, vertical portion 97*a* of arms 94*a* is joined to pivot member 50*a*. Specifically, a fastener (not shown) is inserted through both opening 99*a* located in vertical portion 97*a* and opening 152 of pivot member 50*a*. The selected fastener may be of any type that allows pivot member 50*a* to rotate about the fastener.

Figure 6E:
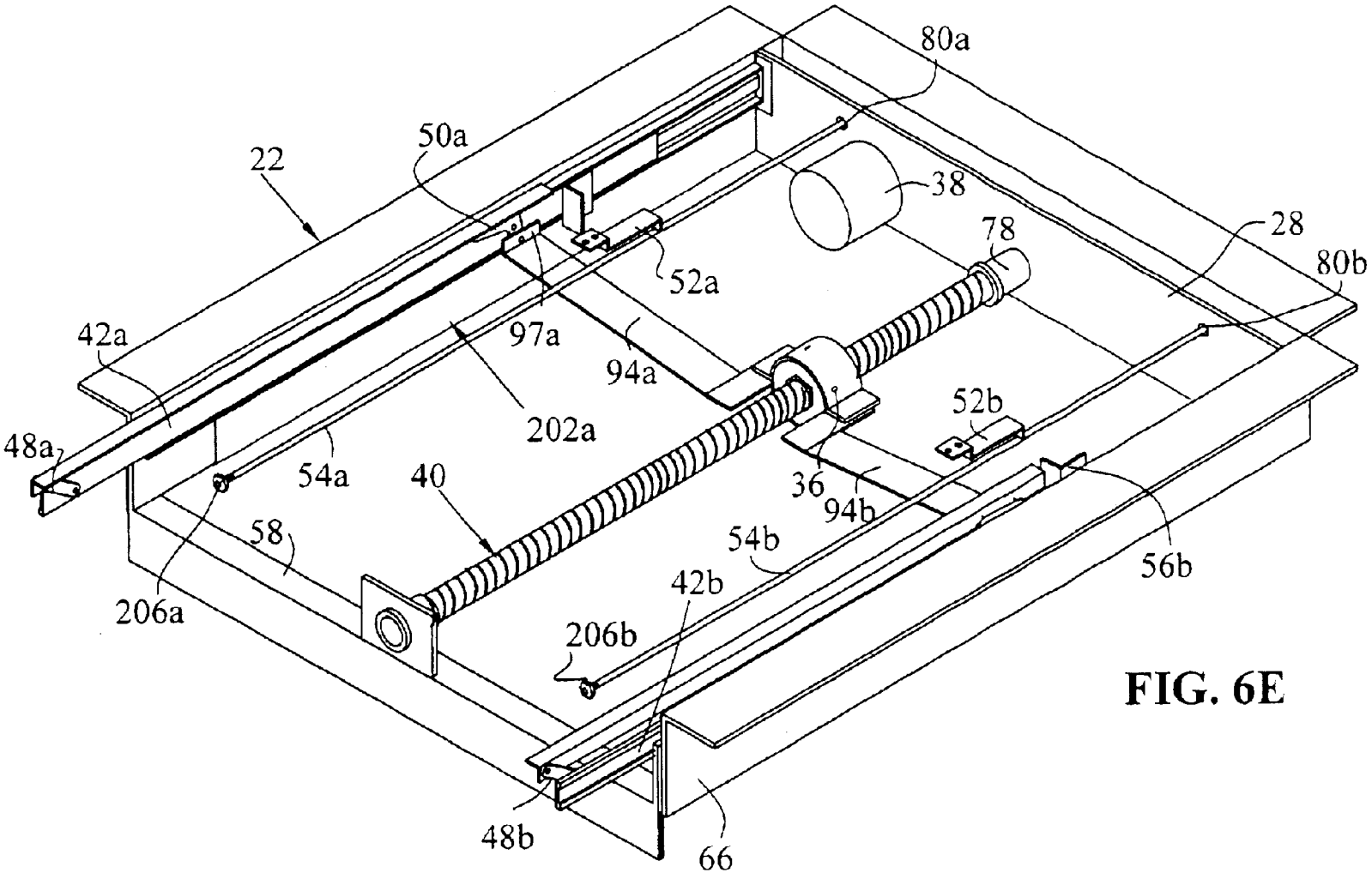

As shown in FIG. 6E dowels 54*a*, 54*b* are inserted into openings 80*a*, 80*b*, respectively, located in plate 28. The dowels 54*a*, 54*b* are inserted a sufficient distance into plate 28 to ensure that one of the threaded portions 174 (depicted in FIG. 5) extends completely through the openings 80*a*, 80*b*. A nut (not shown), or similar means, is then threaded onto the threaded portion that was inserted into plate 28.

Stops 52*a*, 52*b* are then slid onto dowels 54*a*, 54*b* opposite the nut. Specifically, dowels 54*a*, 54*b* extend through opening 168 of stops 52*a*, 52*b*. Once stops 52*a*, 52*b* have been joined to dowels 54*a*, 54*b*, nuts 206*a*, 206*b* are threaded onto threaded portion 174 of the dowels 54*a*, 54*b*. The addition of nuts 206*a*, 206*b* retains stops 52*a*, 52*b* on dowels 54*a*, 54*b*, respectively, and further retains dowels 54*a*, 54*b* within plate 28.

Figure 6F:
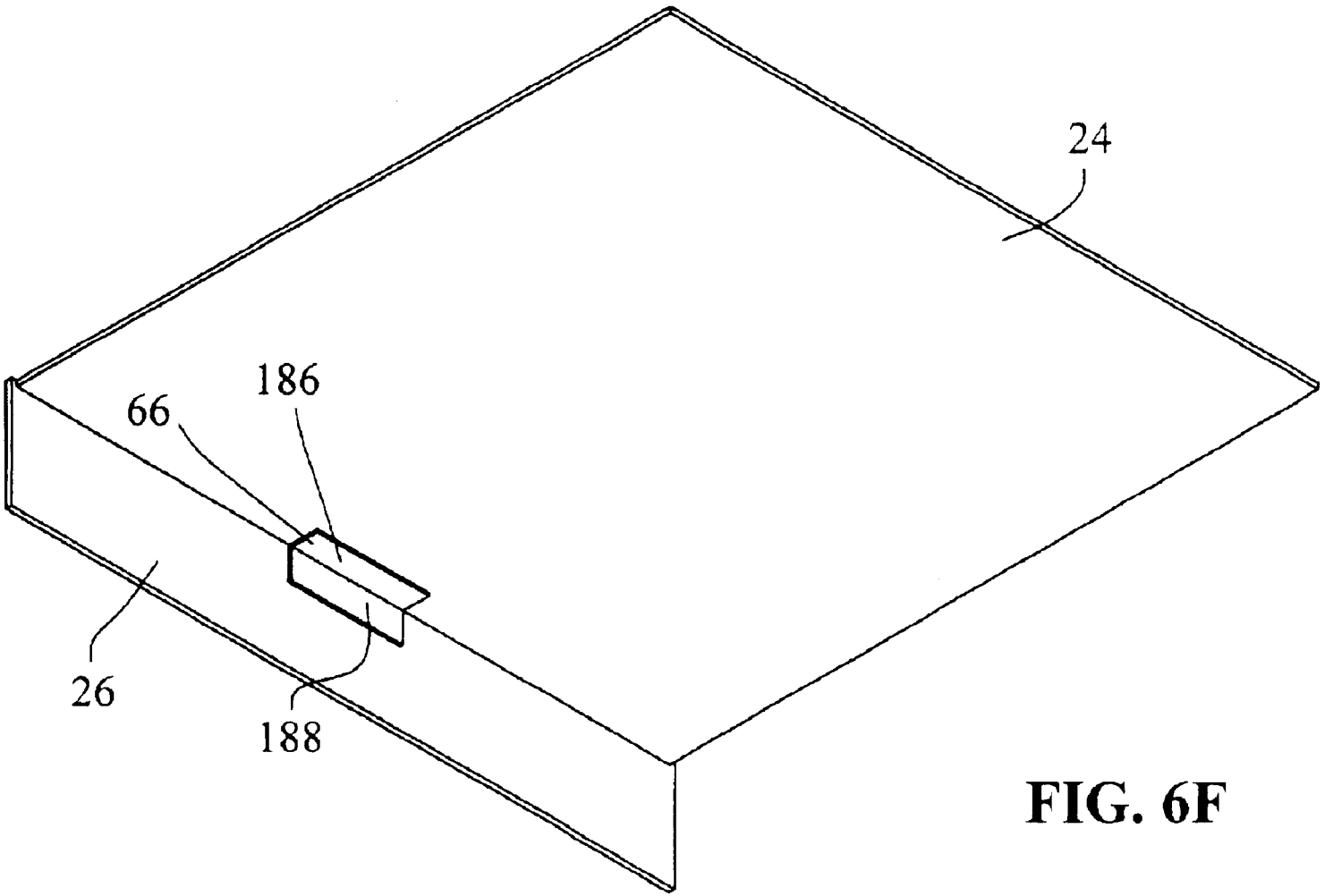

Referring now to FIG. 6F, bracket 60 joins together horizontal cover 24 and vertical cover 26. Specifically, horizontal cover 24 is attached to horizontal portion 186 of bracket 60 by way of fasteners (not shown) or via another method. In a similar manner, vertical cover 26 attaches to vertical portion 188 of bracket 60. However, it should be noted that horizontal cover 24 and vertical cover 26 may be manufactured as a one-piece component in which bracket 66 need not be used.

Figure 6G:
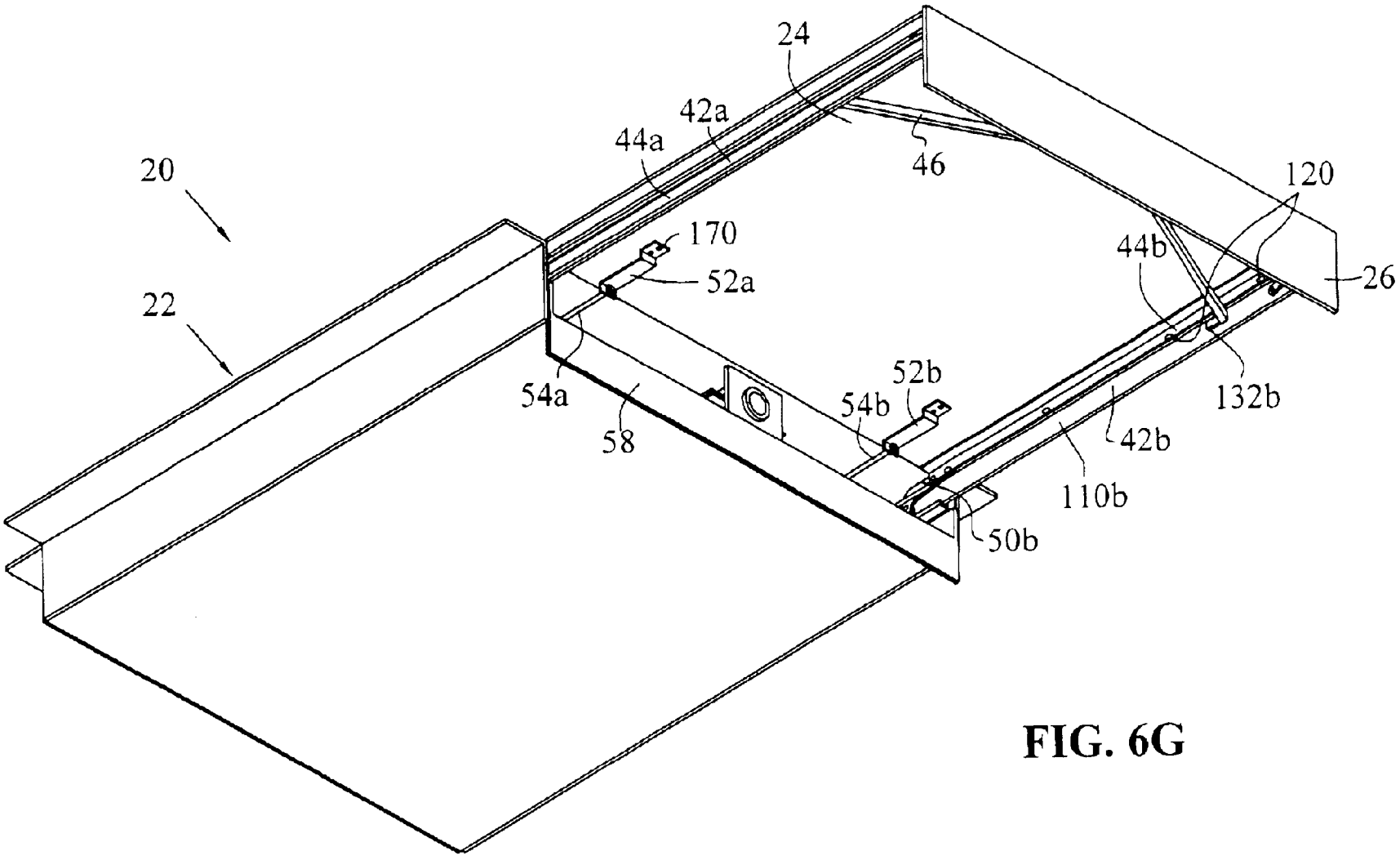
Figure 6H:
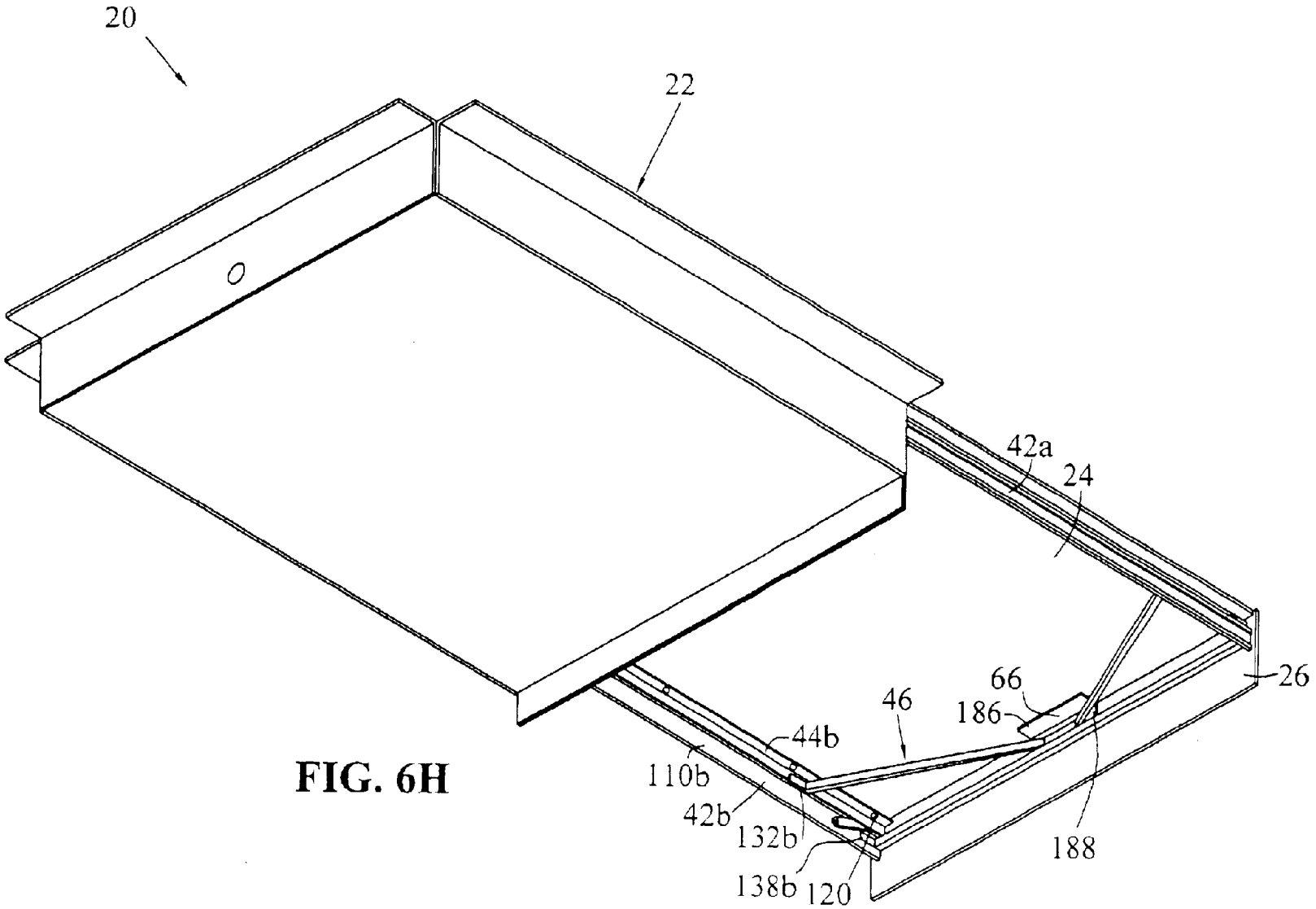

The horizontal cover 24 is now attached to brackets 44*a*, 44*b* and stops 52*a*, 52*b* as is depicted in FIGS. 6G and 6H, as described below. In this embodiment, the attachment is accomplished with the use of a plurality of fasteners (not shown) inserted into the openings 120 of brackets 44*a*, 44*b*. Fasteners are also used to join stops 52*a*, 52*b* to the horizontal cover 24 by extending into the cover 24 through openings 170.

Referring now to FIGS. 5, 6G, and 6H, cross-support 46 is attached to the movable members 110*a*, 10*b*. Specifically, support plates 132*a*, 138*a* are attached to movable member 110*a*, while support plates 132*b*, 138*b* are attached to movable member 110*b*. Cross-support 46 is located in a position relative to slide assemblies 42*a*, 42*b* as a means to help align the moveable members 110*a*, 110*b*, as the moveable members 110*a*, 110*b* slide within fixed members 112*a*, 112*b*. The addition of cross-support member 46 completes the assembly process of apparatus 20. As stated above, the order of the steps comprising the assembly described above may altered as desired.

Figure 7:
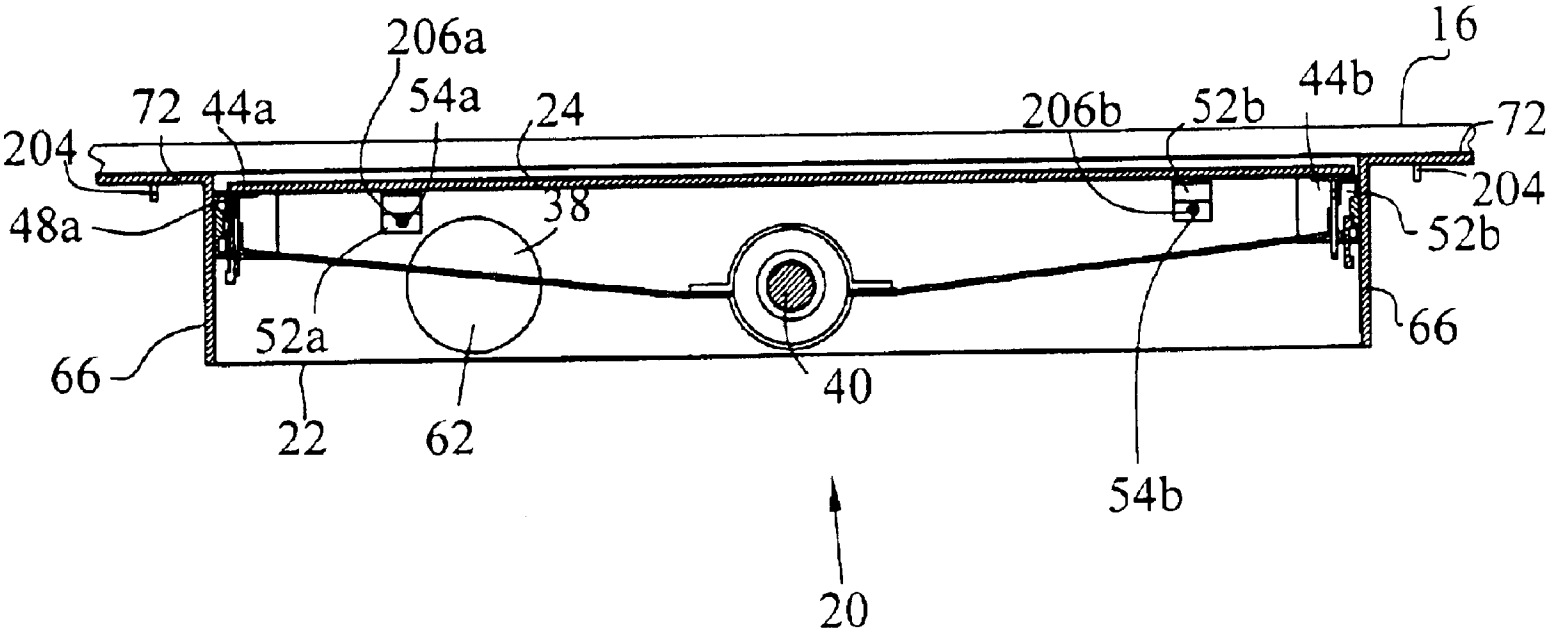
FIG. 7 depicts a section view taken along line 7 illustrated in FIG. 1.

Following the assembly of stepwell cover apparatus 20, as described above, the apparatus 20 is then installed into a recreational vehicle 10, as is depicted in FIGS. 1 and 7. FIG. 7 depicts a front sectional view of the installed apparatus 20 taken along the section line 7 shown in FIG. 1.

As is depicted in FIG. 7, stepwell cover apparatus 20 resides under floor 16 of vehicle 10. Stepwell cover apparatus 20 is affixed to floor 16 by way of a plurality of fasteners 204. The fasteners 204 extend through the flanges 72 of frame 22 and into floor 16 and are inserted at various locations throughout the flanges 72 in sufficient quantity to ensure the stepwell cover apparatus 20 remains secured to the floor 16. Referring still to both FIG. 1 and FIG. 7, it should be noted that when stepwell cover apparatus 20 is installed within vehicle 10 the horizontal cover resides below the level of floor 16 when retracted and hidden from view. Furthermore, as is depicted in FIG. 1, vertical cover 26 is the only component of the apparatus visible to the vehicle occupants when retracted.

Now that the components and the assembly of the stepwell cover apparatus 20 has been covered in detail; the function of stepwell cover apparatus 20 will now be explained, with reference to FIGS. 8A–8E and 9A–9E. In addition, it should be noted that the stepwell cover apparatus 20 shown in FIGS. 8A–8E is depicted with horizontal portion 76 of plate 28, base 62 of frame 22, and cross-support 46 not present, in order to present a better view of the internal components comprising the stepwell cover apparatus 20.

Figure 8A:
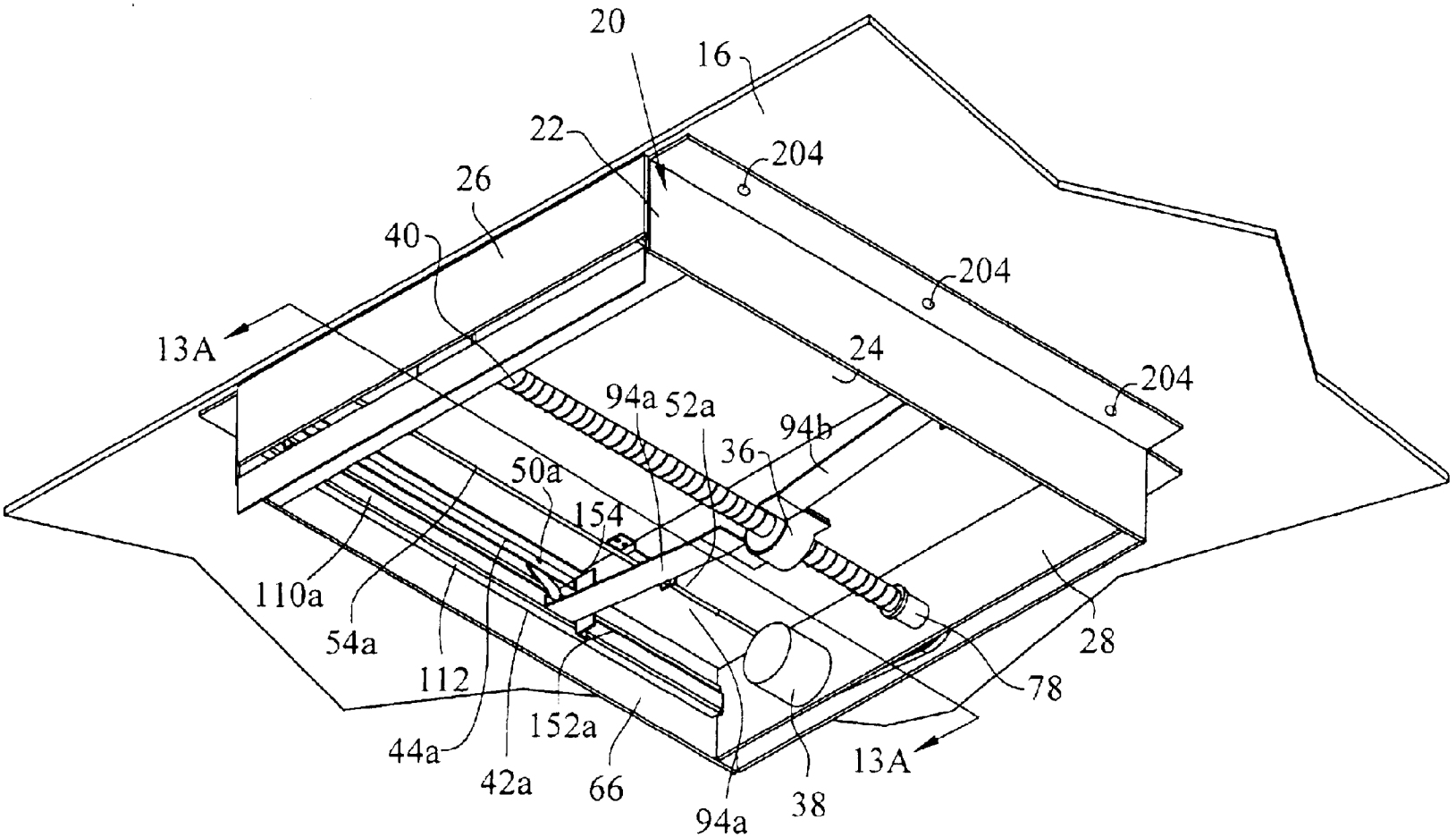
FIGS. 8A–8E depict bottom perspective views of the stepwell cover apparatus illustrated in FIG. 2 as the apparatus travels from the fully retracted position to the fully extended position.
Figure 9A:
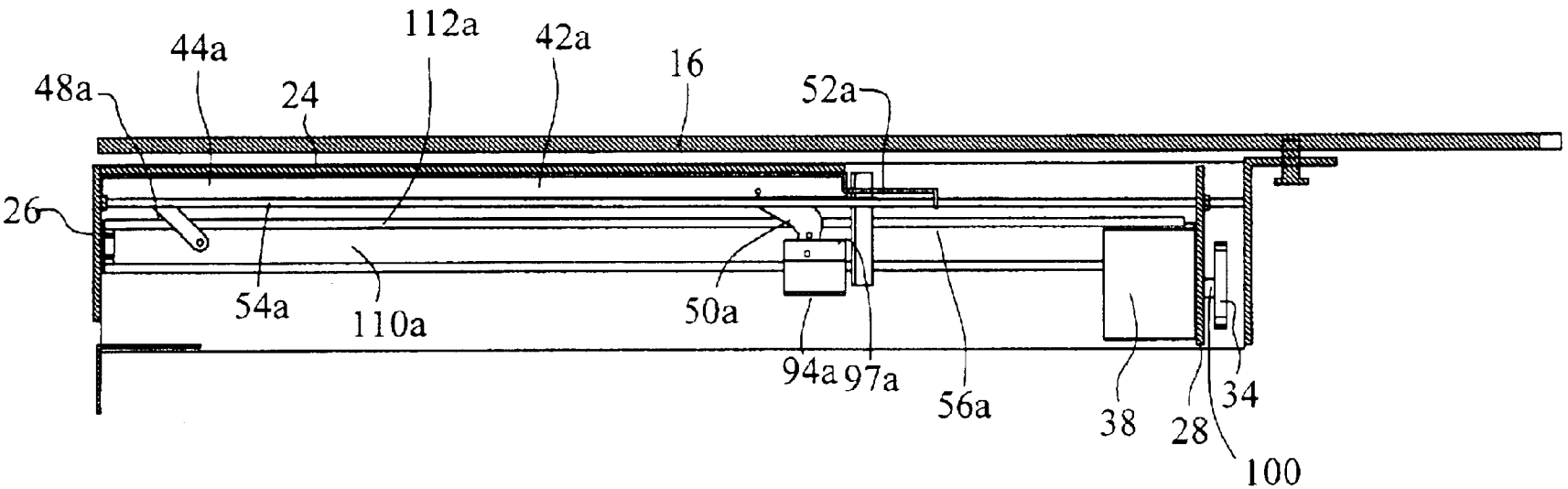
FIGS. 9A–9E depict section views of the stepwell cover apparatus illustrated in FIGS. 8A–8E, respectively, taken along lines 9A–9E, respectively.

FIGS. 8A and 9A depict stepwell cover apparatus 20 in a fully retracted position. When retracted, horizontal cover 24 is located beneath the floor 16. Furthermore, as seen in FIG. 13A specifically, the only portion of stepwell cover apparatus 20 visible to a vehicle occupant is vertical cover 26.

When it is desirable to conceal the stepwell 18, the occupant activates motor 38 of apparatus 20 in a known manner, employing, for example, a switch. Activating motor 38 rotates shaft 100 which, in turn, rotates rod 40 via mechanism 34. The rotation of rod 40 forces drive assembly 36, in addition to the pivot members 50*a*, 50*b* attached thereto via arms 94*a*, 94*b*, away from plate 28. Furthermore, the movement of the pivot members 50*a*, 50*b* creates movement in the movable members 110*a*, 110*b* and the brackets 44*a*, 44*b* connecting the pivot members 50*a*, 50*b* to the cover 24.

Figure 8B:
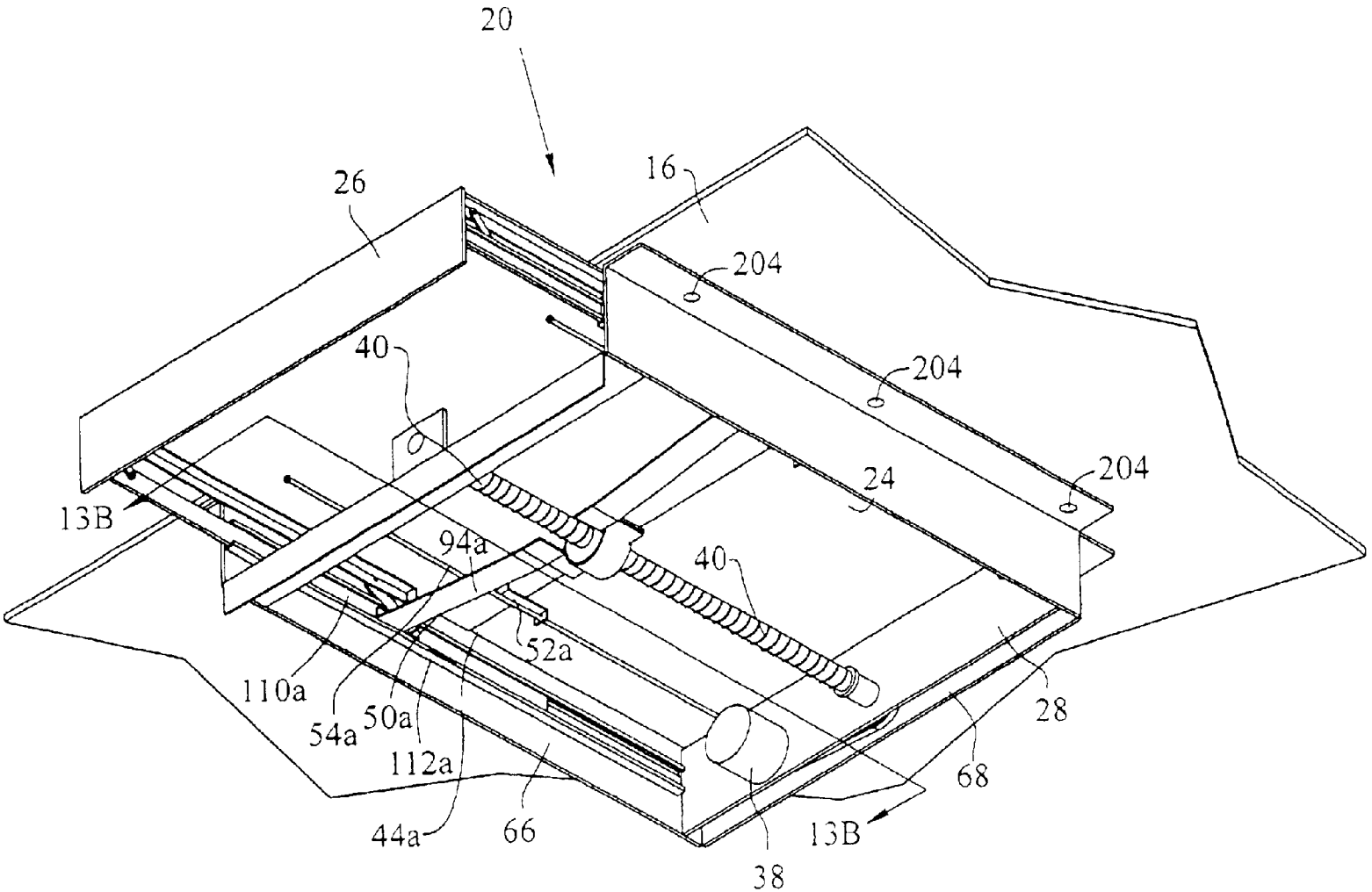
Figure 9B:
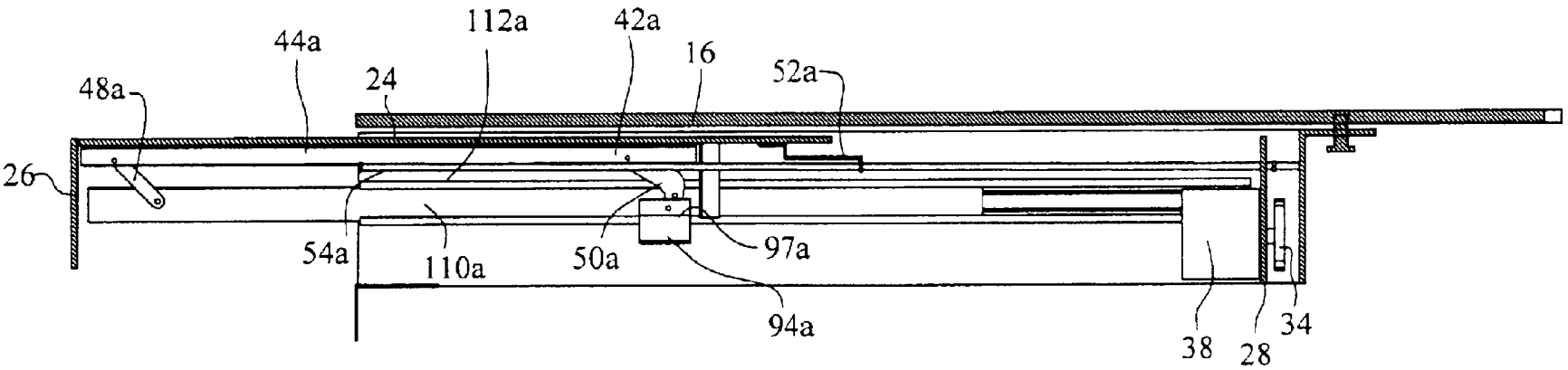

FIGS. 8B and 9B depict a view of the stepwell cover apparatus 20 with horizontal cover 24 partially extended from beneath floor 16. As described above, the activation of motor 38 results in movement of drive assembly 36, moveable members 110*a*, 110*b*, pivot members 48*a*, 48*b*, 50*a*, 50*b*, stops 52*a*, 52*b* and the horizontal and vertical covers 24, 26. It should be noted that, as depicted, horizontal cover 24 is still located below floor 16.

Figure 8C:
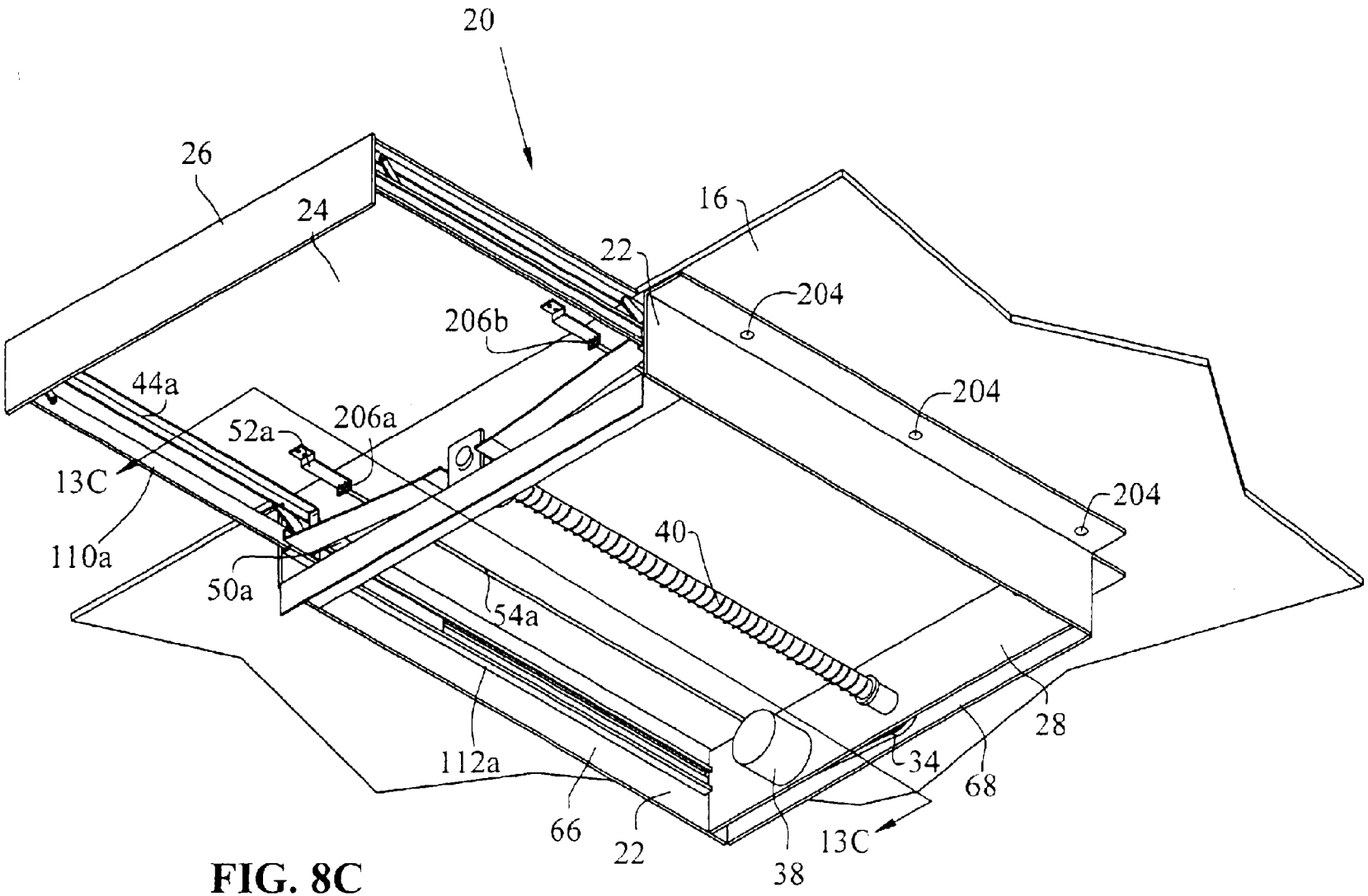
Figure 9C:
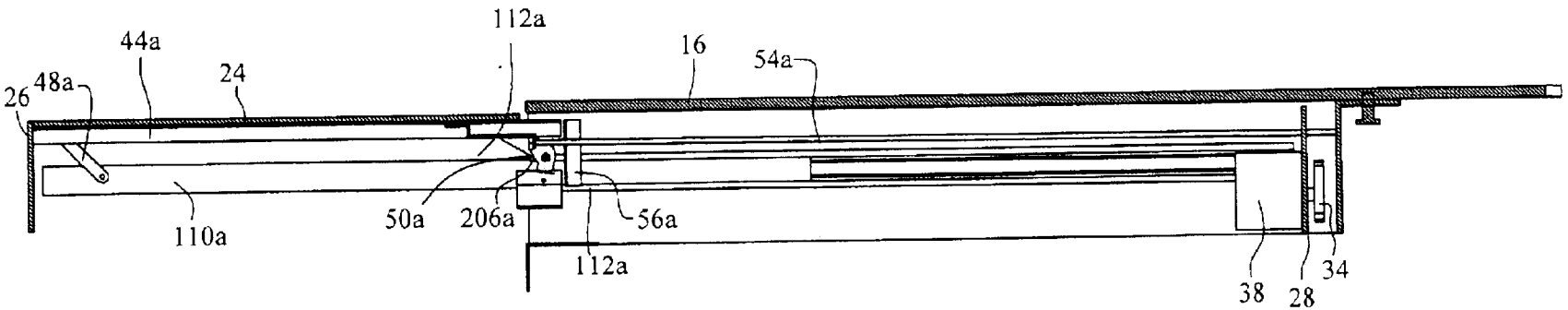

The movement described above continues until the stops 52*a*, 52*b* traversing dowels 54*a*, 54*b*, respectively, contact the nuts 206*a*, 206*b*, each of which is affixed to the forward end of the dowels 54*a*, 54*b*, as described above. This position is illustrated in FIGS. 8C and 9C. Referring to these figures, it can be seen that horizontal cover 24 is still located vertically below floor 16 but is positioned forward of the leading edge of floor 16. Furthermore, it should be noted that the long portions 148 of pivot members 50*a*, 50*b* are still substantially orientated horizontally at this point of the process.

Figure 8D:
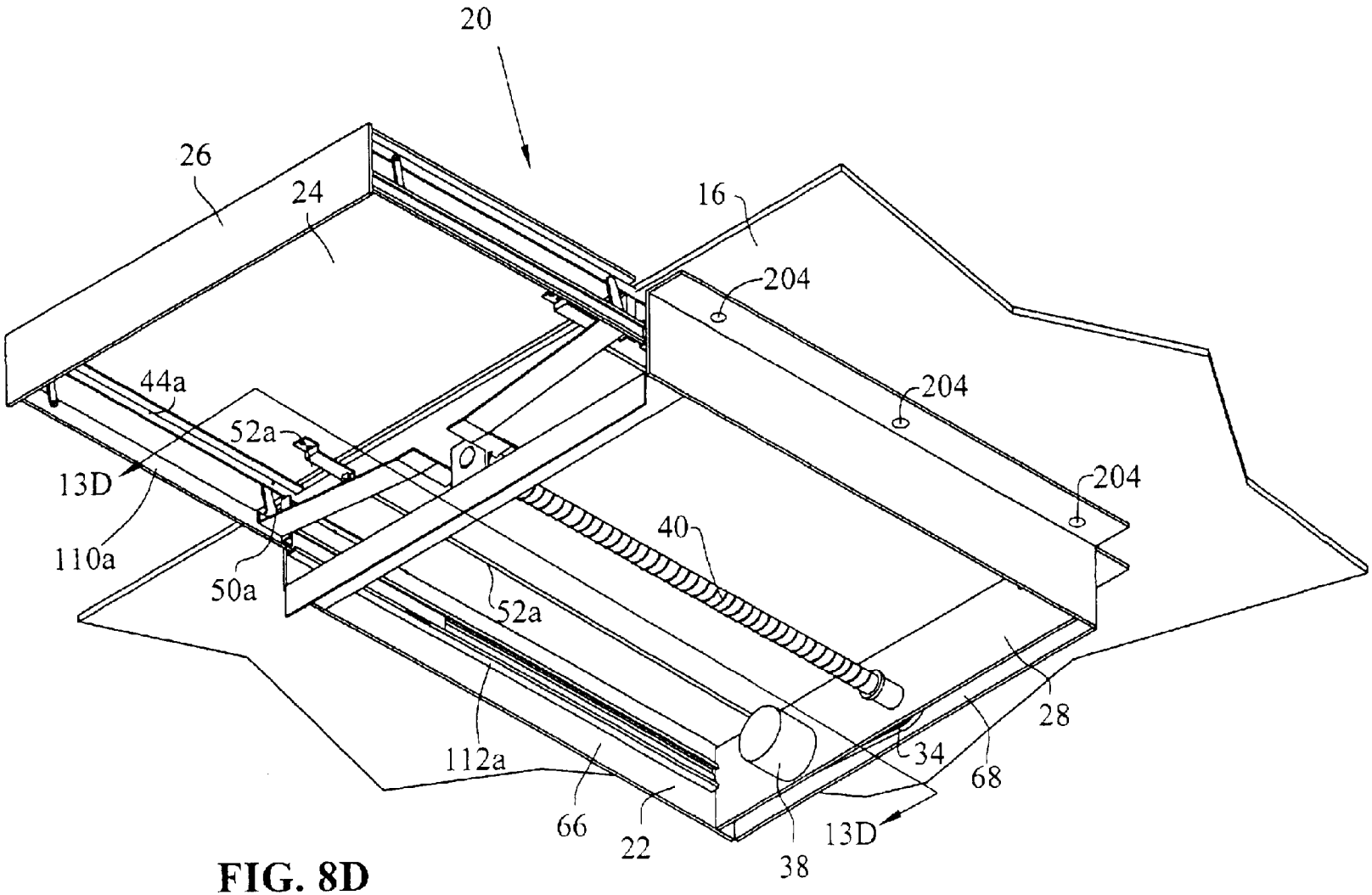
Figure 8E:
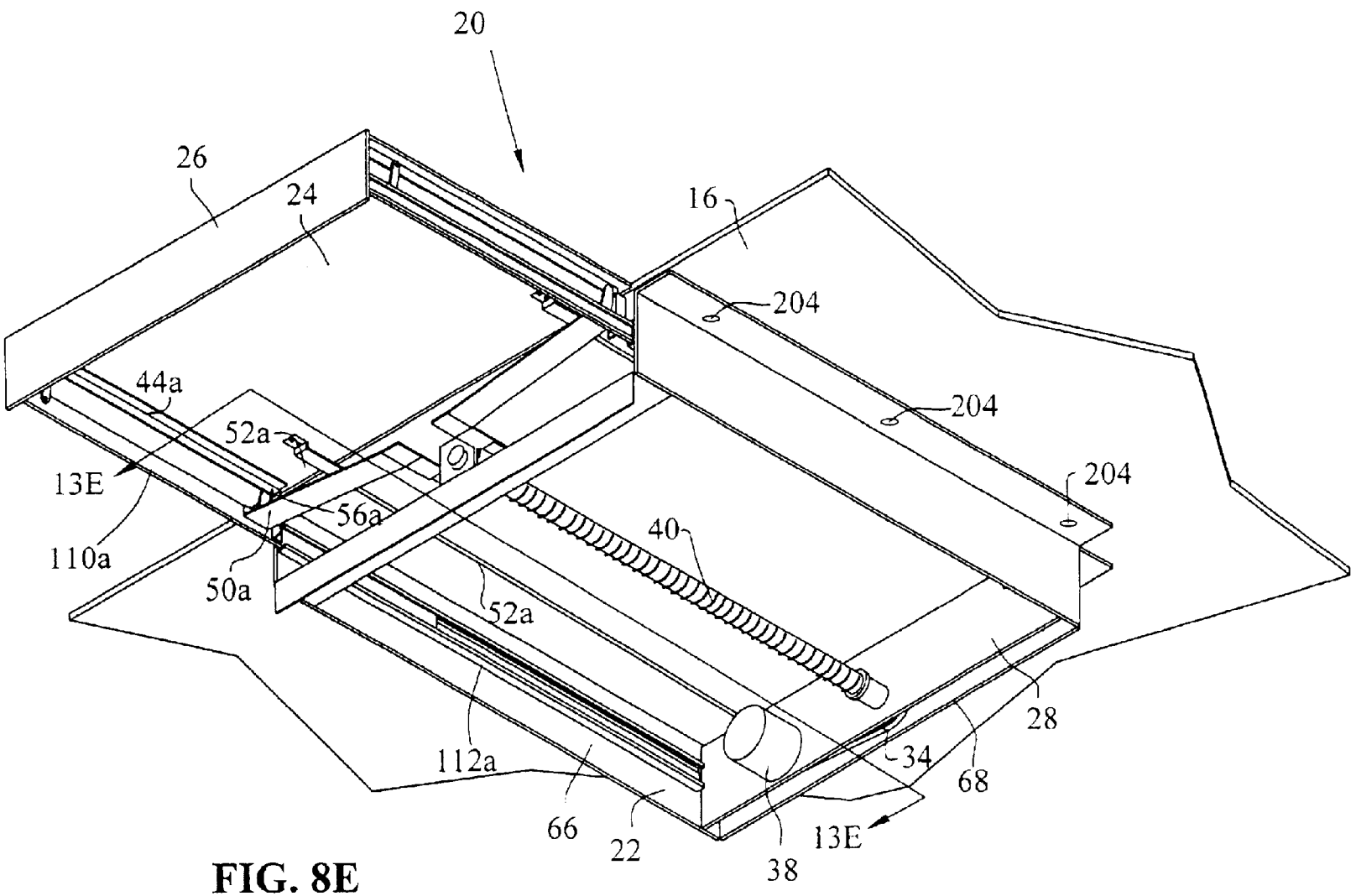
Figure 9D:
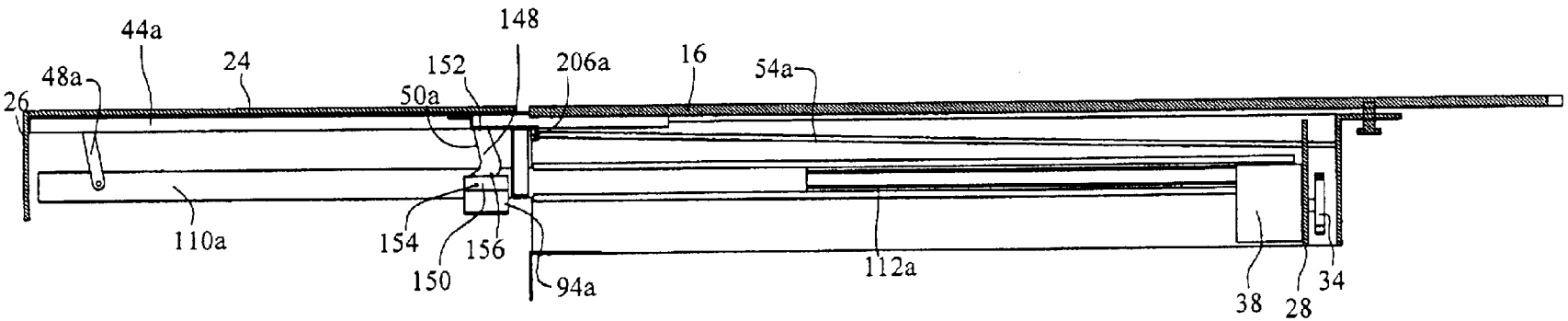

FIGS. 8D and 9D depict the continued operation of apparatus 20. As depicted, the continued movement of drive assembly 36 drives horizontal cover 24 until the stops 52*a*, 52*b* contact the nuts 206*a*, 206*b*, as is depicted in FIGS. 8C and 9C. At this point, the horizontal cover 24 is prevented from traveling forward away from plate 28. However, rod 40 still continues to rotate, thereby causing drive assembly 36 to continue traveling forward, away from plate 28, as described above. In addition, the connection between the arms 94*a*, 94*b* and the openings 154 of the pivot members 50*a*, 50*b* also drives the openings 154 away from plate 28. However, the engagement between the nuts 206*a*, 206*b* and the stops 52*a*, 52*b* prevents the continued forward movement of horizontal cover 24, the brackets 44*a*, 44*b*, and the pivot members 50*a*, 50*b*. Consequently, the continued forward movement of the openings 154 will cause the pivot members 50*a*, 50*b* to pivot about the openings 156, as is depicted in FIGS. 12D and 13D, thereby elevating the openings 152 and changing the orientation of long portion 148 from substantially horizontal (as is depicted in FIGS. 8A–8C) to substantially vertical (as is depicted in FIGS. 8D–8E). This rotation of pivot members 50*a*, 50*b* lifts the brackets 44*a*, 44*b* and the horizontal cover 24.

It should be noted that the stops 52*a*, 52*b* also rise with horizontal cover 24. The lifting of the stops 52*a*, 52*b* alters the orientation of the dowels 54*a*, 54*b* causing the ends of the dowels 54*a*, 54*b* near the stops 52*a*, 52*b* to raise up with the stops 52*a*, 52*b*. This is possible due to the difference in the diameters of the openings 80*a*, 80*b* and the dowels 54*a*, 54*b*.

Figure 9E:
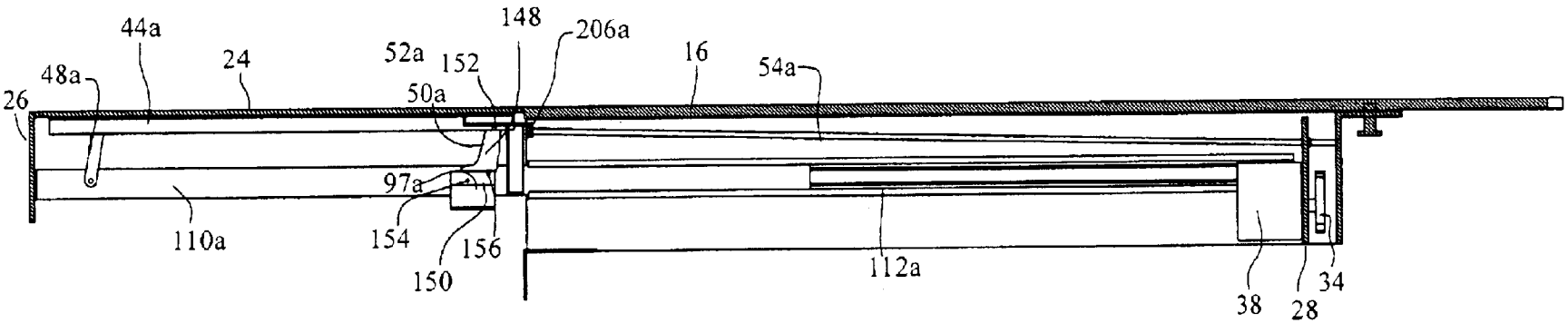

FIGS. 8E and 9E both depict a fully extended stepwell cover apparatus 20. Generally, any means known may be employed to deactivate the motor 38 when drive assembly 36 reaches the fully extended position.

In addition, one skilled in the art should appreciate that in this embodiment, the top surface of horizontal cover 24 lies in the same plane as the top surface of floor 16, while the edge of horizontal cover 24 abuts against the edge of floor 16. Furthermore, it should be appreciated that the surface area of horizontal cover 24 is sufficiently large to conceal the steps 14 (FIG. 1) when extended, thereby allowing the occupants to increase the usable floor space of vehicle 10 (FIG. 1).

It should also be noted that the pivot members 50*a*, 50*b* are orientated with opening 152 located over-the-center of opening 156, as depicted in FIGS. 8E and 9E. This over-the-center rotation results in the pivot members 50*a*, 50*b* attempting to continue with rotation in the rearward direction when horizontal cover 24 is loaded. However, the interaction between the horizontal cover 24 and floor 16 prevents the pivot members 50*a*, 50*b* from further rotating. Consequently, a portion of the loads supported by horizontal cover 24 is transferred to floor 16, thereby allowing apparatus 20 to support greater loads.

In addition, the horizontal cover 24 is further supported by the interaction between the brackets 44*a*, 44*b* and the angle irons 56*a*, 56*b*. As is depicted in both FIGS. 8E and 9E, the brackets 44*a*, 44*b* rest upon the angle irons 56*a*, 56*b* when horizontal cover 24 is fully extended. This engagement reduces the magnitude of the forces supported directly by the pivot members 50*a*, 50*b* by transferring a portion of the forces from horizontal cover 24 into the angle irons 56*a*, 56*b* through brackets 44*a*, 44*b*.

The horizontal cover 24 of apparatus 20 may be retracted by the activation of motor 38 in the direction opposite that utilized above. This creates rotation of rod 40 in the opposite direction, thereby withdrawing drive assembly 36 rearward toward plate 28. Again, as drive assembly 36 moves toward plate 28; the openings 154 of the pivot members 50*a*, 50*b* are drawn in the same direction. Horizontal cover 24, however, is prevented from moving toward plate 28 due to the contact with floor 16.

The above-described contact between horizontal cover 24 and floor 16 causes the pivot members 50*a*, 50*b* to rotate about openings 156, thereby lowering the openings 152. This movement, in turn, lowers horizontal cover 24 below the level of floor 16. Once the pivot members 50*a*, 50*b* rotate into the position illustrated in FIGS. 8C and 9C, with horizontal cover 24 lowered below floor 16, the movement of drive assembly 36 withdraws movable member 110*a*, 110*b* and the horizontal cover 24 to a position beneath floor 16, thereby exposing the steps 14 as depicted in FIG. 1.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

What we claim is:

1. A stepwell cover apparatus for use in a vehicle having a floor and a stepwell including at least one step including:

a horizontal cover;

a pivoting member having a first end and a second end, the first end being joined to the horizontal cover;

a drive mechanism including a rod and a drive assembly able to traverse the length of the rod and including an arm attached to the second end of the pivoting member;

a guide mechanism including a sliding assembly, the pivoting member pivotally connected to the sliding assembly between the first end of the pivoting member and the second end of the pivoting member;

a first stop member attached to the horizontal cover and including an opening;

a first dowel located within the opening of the first stop member including a first stationary end and a second end;

wherein movement of the drive assembly moves the horizontal cover between a fully retracted position and a fully extended position, the horizontal cover exposing the at least one step and being located below the floor when in the fully retracted position and concealing the at least one step and being located flush with the floor when in the fully extended position.

2. The stepwell cover apparatus as set forth in claim 1 further including a frame having a base and a plurality of walls defining an inner space housing the guide mechanism when in the fully retracted position.

3. The stepwell cover apparatus as set forth in claim 1 further including a plate connected to the first stationary end of the dowel.

4. The stepwell cover apparatus as set forth in claim 3 wherein the plate includes an opening and the first stationary end of the dowel is located within the opening.

5. The stepwell cover apparatus as set forth in claim 1 wherein the drive mechanism further includes a motor and a pulley mechanism, the motor being connected to the rod by way of the pulley mechanism.

6. The stepwell cover apparatus as set forth in claim 1 wherein the drive assembly further includes a nut threaded onto the rod, a nut cage joined to the nut and wherein the arm of the drive assembly extends from the nut cage.

7. The stepwell cover apparatus as set forth in claim 1 further including a bracket attached to the horizontal cover, the bracket connecting the first end of the pivot member to the horizontal cover.

8. The stepwell cover apparatus as set forth in claim 7 further including a second pivot member, the second pivot member having first end joined to the bracket and a second end joined to the sliding assembly.

9. The stepwell cover apparatus as set forth in claim 8 wherein rotation of the pivot members cause a vertical movement of the horizontal cover.

10. The stepwell cover apparatus as set forth in claim 1 further including a vertical cover joined to the horizontal cover.

* * * * *